US008695545B2

(12) United States Patent
Tateno

(10) Patent No.: US 8,695,545 B2
(45) Date of Patent: Apr. 15, 2014

(54) PHASE CHANGING DEVICE OF CAMSHAFT

(75) Inventor: Manabu Tateno, Sunto-gun (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 181 days.

(21) Appl. No.: 13/394,065

(22) PCT Filed: Mar. 31, 2011

(86) PCT No.: PCT/JP2011/058311

§ 371 (c)(1),
(2), (4) Date: Mar. 2, 2012

(87) PCT Pub. No.: WO2012/132002

PCT Pub. Date: Oct. 4, 2012

(65) Prior Publication Data

US 2012/0279464 A1 Nov. 8, 2012

(51) Int. Cl.
*F01L 1/34* (2006.01)

(52) U.S. Cl.
USPC ..... 123/90.15; 123/90.17; 123/90.6

(58) Field of Classification Search
USPC ..... 123/90.15, 90.17, 90.6
See application file for complete search history.

(56) References Cited

U.S. PATENT DOCUMENTS

| | | | | |
|---|---|---|---|---|
| 7,536,986 | B2 | 5/2009 | Schneider | |
| 2007/0240657 | A1 | 10/2007 | Schneider | |
| 2012/0279464 | A1 * | 11/2012 | Tateno | 123/90.15 |

FOREIGN PATENT DOCUMENTS

| | | | |
|---|---|---|---|
| JP | 2002-54410 | A | 2/2002 |
| JP | 2002-180807 | A | 6/2002 |
| JP | 2006-105062 | A | 4/2006 |
| JP | 2008-528871 | A | 7/2008 |
| JP | 2009-144521 | A | 7/2009 |
| JP | 2009-293567 | A | 12/2009 |

* cited by examiner

*Primary Examiner* — Thomas Denion
*Assistant Examiner* — Jorge Leon, Jr.
(74) *Attorney, Agent, or Firm* — Sughrue Mion, PLLC

(57) ABSTRACT

A phase changing device 100A of a camshaft is provided to a dual structure camshaft 10 which is rotated by a driving force input thereto and which includes an inner shaft 11 and an outer shaft 12. The phase changing device 100A of the camshaft includes a phase changing portion 1A including a single housing 2 defining: an advance hydraulic chamber R1 advancing wholly a phase of the camshaft 10 by a hydraulic pressure; a retard hydraulic chamber R2 retarding wholly the phase of the camshaft 10 by a hydraulic pressure; and a phase difference hydraulic chamber R3 changing a difference between a phase of the inner shaft 11 and a phase of the outer shaft 12 by a hydraulic pressure.

10 Claims, 15 Drawing Sheets

PHASE CHANGING DEVICE OF CAMSHAFT

CROSS REFERENCE TO RELATED APPLICATIONS

This application is a National Stage of International Application No. PCT/JP2011/058311, filed on Mar. 31, 2011, the contents of all of which are incorporated herein by reference in their entirety.

TECHNICAL FIELD

The present invention relates to a phase changing device of a camshaft, and more particularly, to the phase changing device provided to a dual structure camshaft including an inner shaft and an outer shaft.

BACKGROUND ART

For example, a dual structure camshaft is used for an engine. Patent Document 1 discloses a valve timing device including: a camshaft composed of an inner camshaft and an outer camshaft; and a first phase control mechanism and a second phase control mechanism respectively provided at both ends of the camshaft. Patent Document 2 discloses a camshaft including an inner shaft and an outer shaft that are provided at one end thereof with a hydraulic device.

PRIOR ART DOCUMENT

Patent Document

[Patent Document 1] Japanese Patent Application Publication No. 2009-144521

[Patent Document 2] Japanese National Publication of International Patent Application Publication No. 2008-528871

SUMMARY OF THE INVENTION

Problems to be Solved by the Invention

The camshaft having the dual structure rotates in response to the input driving force. In contrast, in order to control the phase of the dual structure camshaft, the phase of the camshaft is wholly advanced or retarded, and in addition the phase difference between the inner shaft and the outer shaft is changed. In order to control the phase in such a way, the first and second phase control mechanisms may be provided as an example of the valve timing device disclosed in Patent Document 1.

However, two phase control mechanisms each have a hydraulic chamber for advance and a hydraulic chamber for retard, that is, there are four hydraulic chambers. Thus, there may be a disadvantage of downsizing. Additionally, since two phase control mechanisms are independently provided in the axial direction, the full length in the axial direction tends to be longer. Thus, there may be a disadvantage of downsizing. Further, since two phase control mechanisms are independently provided in the axial direction, there is a cost disadvantage.

Moreover, two phase control mechanisms have to be controlled in this case. Therefore, it may be complicated to control the phase of the camshaft. In addition, torque reaction forces are applied to each of the phase control mechanisms from the inner shaft and the outer shaft. For this reason, the torque reaction forces are canceled or increased depending on the phase difference between the inner and outer shafts. This influences the torque variation of the whole camshaft. Thus, it may be difficult to desirably control the phase of the camshaft as desired.

The present invention has been made in view of the above circumstances and has an object to provide a phase changing device of a camshaft which controls a phase of a dual structure camshaft with an advantage of downsizing and saving cost, and which suitably control the phase of the camshaft.

Means for Solving the Problems

The present invention is a phase changing device of a camshaft provided to a dual structure camshaft which is rotated by a driving force input thereto and which includes an inner shaft and an outer shaft, the camshaft phase changing device including a phase changing portion comprising a single housing defining: an advance hydraulic chamber advancing wholly a phase of the camshaft by a hydraulic pressure; a retard hydraulic chamber retarding wholly the phase of the camshaft by a hydraulic pressure; and a phase difference hydraulic chamber changing a difference between a phase of the inner shaft and a phase of the outer shaft by a hydraulic pressure.

In the present invention, the advance hydraulic chamber, the retard hydraulic chamber, and the phase difference hydraulic chamber may be arranged in a circumferential direction of the camshaft, and may define a pair of the hydraulic chambers acting on one another.

In the present invention, the phase changing portion may include: a housing as the housing into which a driving force for driving the camshaft is input; a first rotor driving the inner shaft; and a second rotor driving the outer shaft, and the housing may be sandwiched between the first and second rotors.

In the present invention, the first and second rotors may respectively include rotor bodies, and each of the rotor bodies may be provided at an outer circumferential portion with a sliding portion slidable with respect to the housing.

In the present invention, the housing may include a driving force input portion into which the driving force is input and which overlaps the second rotor in an axial direction.

In the present invention, the inner shaft may include a flange portion sandwiched between the second rotor and the outer shaft in an axial direction with the phase changing portion provided to the camshaft.

In the present invention, the outer shaft selected from the inner and outer shafts may be provided within the outer shaft with hydraulic path portions which respectively communicate with the advance hydraulic chamber, the retard hydraulic chamber, and the phase difference hydraulic chamber.

In the present invention, the phase changing portion may further include a restraining portion which releasably restrains a relative movement between the first and second rotors.

The present invention may further include: a first hydraulic control valve connected to the advance hydraulic chamber and the retard hydraulic chamber, and controlling a hydraulic pressure to be supplied; and a second hydraulic control valve connected to the first hydraulic pressure control valve and the phase difference hydraulic chamber, and controlling a hydraulic pressure to be supplied.

In the present invention may further include: a first three-way valve connected to the advance hydraulic chamber and the retard hydraulic chamber, and switching a supply destination of the hydraulic pressure; a second three-way valve connected to the retard hydraulic chamber and the phase difference hydraulic chamber, and switching a supply destination of the hydraulic pressure; and a hydraulic pressure control valve connected to the first and second three-way valves, and controlling a hydraulic pressure to be supplied.

Effects of the Invention

The present invention can control a phase of a dual structure camshaft with an advantage of downsizing and saving cost, and suitably control the phase of the camshaft.

MODES FOR CARRYING OUT THE INVENTION

Embodiments according to the present invention will be described with reference to drawings.

[First Embodiment]

Figure 1:
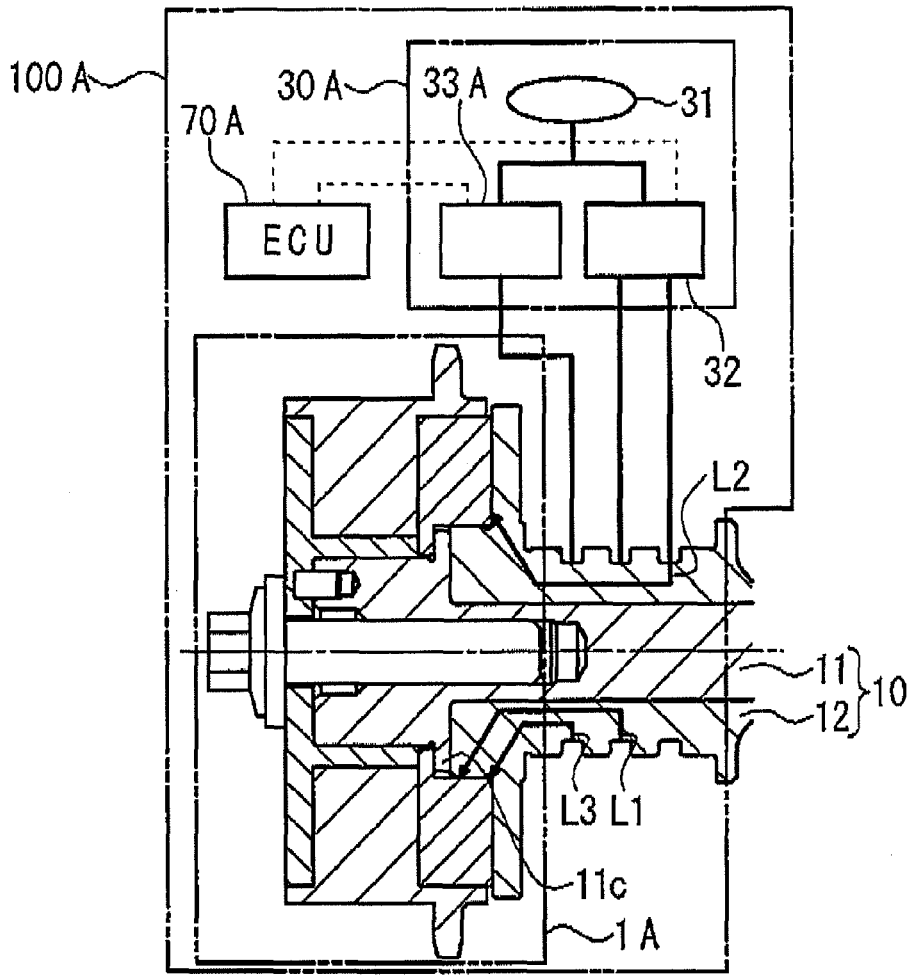
FIG. 1 is a general configuration view of a first embodiment.
Figure 2:
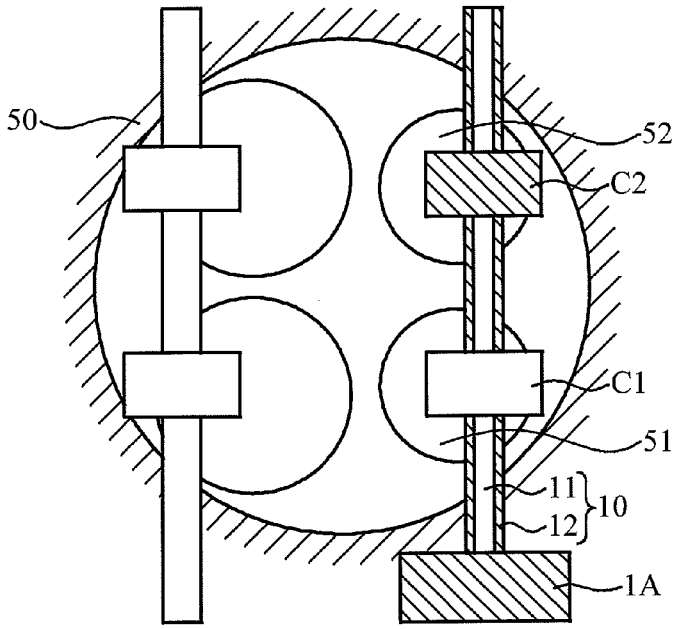
FIG. 2 is a view of a camshaft installed in an engine.

FIG. 1 is a general configuration view of a phase changing device (hereinafter referred to as phase changing device) 100A according to the present embodiment. FIG. 2 is a view of a camshaft 10 installed in an engine 50. FIG. 2 illustrates the engine 50 having the camshaft 10 provided to the same type of two engine valves (herein, intake valves) 51 and 52 for each cylinder. For example, the same type of valves may be exhaust valves.

As illustrated in FIG. 1, the general configuration of the phase changing device 100A includes a phase changing portion 1A, and a hydraulic (corresponding to liquid pressure) circuit portion 30A, and an ECU 70A. The phase changing portion 1A, the hydraulic circuit portion 30A, and the ECU 70A will be described sequentially. The phase changing device 100A is provided in the camshaft 10. In the general configuration of the phase changing device 100A, the camshaft 10 is provided with a flange portion 11*c*, hydraulic path portions L1, L2, and L3 as will be described later.

The camshaft 10 has a dual structure provided with an inner shaft 11 and an outer shaft 12. The inner shaft 11 has a core. The outer shaft 12 has a hollow. The inner shaft 11 is inserted into the outer shaft 12 from its one end. The inner shaft 11 and the outer shaft 12 are concentrically arranged and rotatable relative to each other. The camshaft 10 rotates in response to the input driving force.

As illustrated in FIG. 2, the camshaft 10 is capable of changing the phases of the engine valves 51 and 52 by the inner shaft 11 and the outer shaft 12. In this regard, the inner shaft 11 of the camshaft 10 is provided with a first cam C1 for driving the first engine valve 51, and the outer shaft 12 is provided with a second cam C2 for driving the second engine valve 52.

Figure 3:
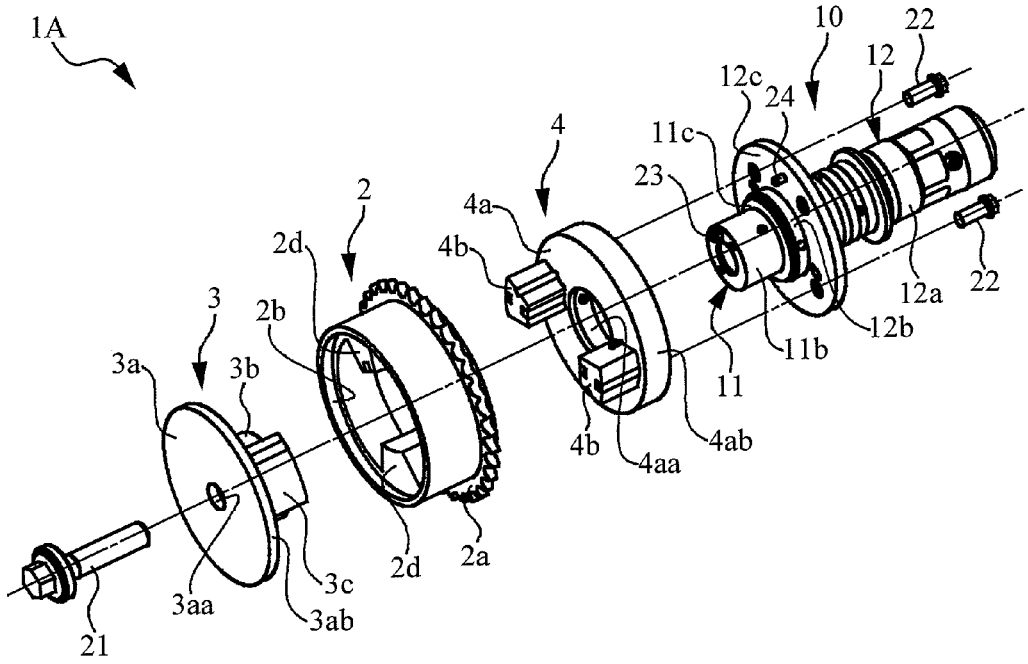
FIG. 3 is an exploded view of a phase changing portion of the first embodiment.
Figure 4:
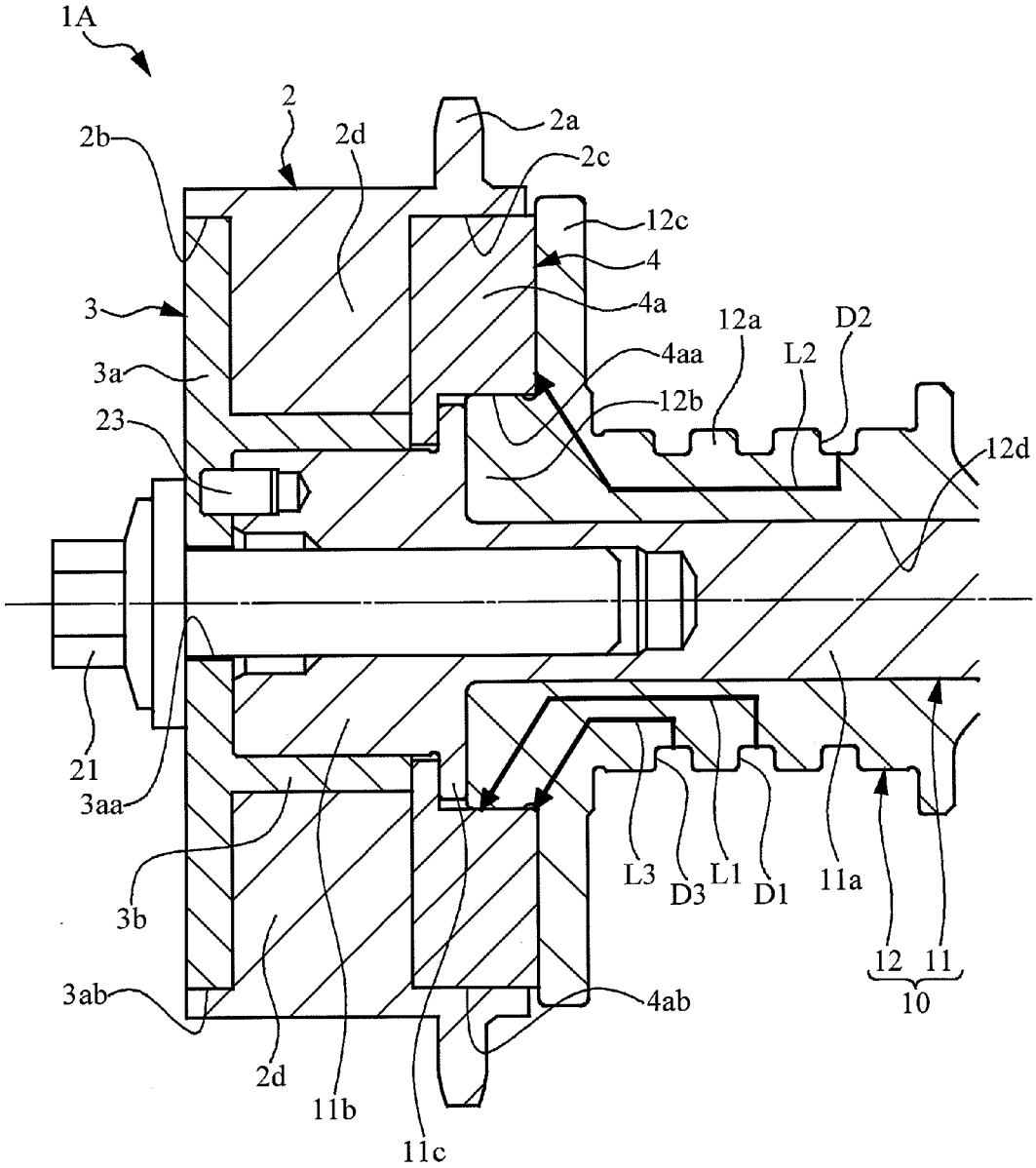
FIG. 4 is a first sectional view of the phase changing portion of the first embodiment.
Figure 5:
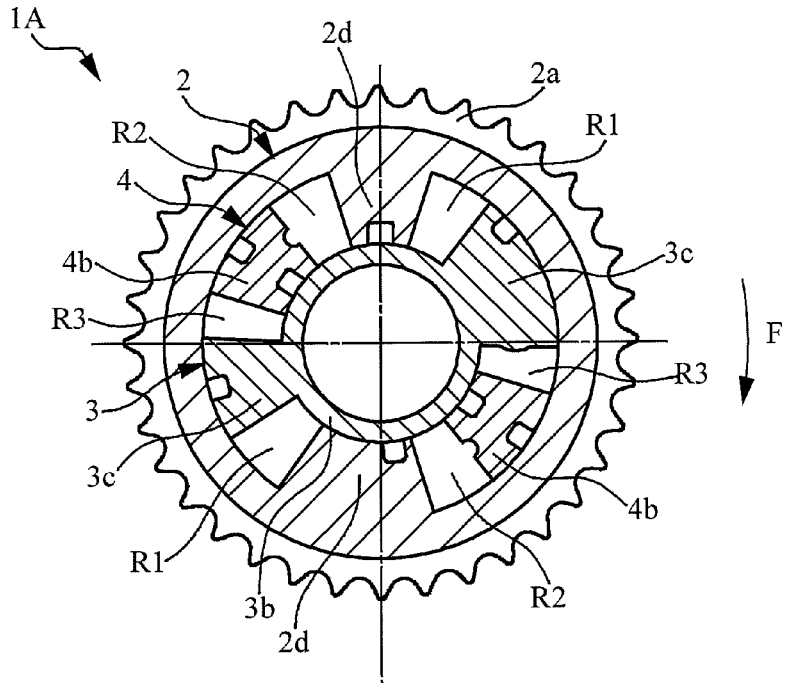
FIG. 5 is a second sectional view of the phase changing portion of the first embodiment.

FIG. 3 is an exploded view of the phase changing portion 1A. FIG. 4 is a first sectional view of the phase changing portion 1A. FIG. 5 is a second sectional view of the phase changing portion 1A. FIGS. 3 and 4 illustrate the phase changing portion 1A in addition to the camshaft 10. FIG. 4 illustrates a cross section including a central axis of the phase changing portion 1A. FIG. 5 illustrates a cross section perpendicular to the central axis of the phase changing portion 1A.

The phase changing portion 1A includes a housing 2, a first rotor 3, and a second rotor 4. The housing 2 has a general cylindrical shape, and includes inner spaces such as an advance hydraulic chamber R1, a retard hydraulic chamber R2, and a phase difference hydraulic chamber R3 as will be described later. The housing 2 includes: a driving force input portion 2*a*; a first sliding portion 2*b*; and a second sliding portion 2*c*, and housing vane portions 2*d*.

The driving force input portion 2*a* is provided at the outer circumferential portion of the housing 2. The driving force for driving the camshaft 10 is input to the housing 2 the through driving force input portion 2*a*. Specifically, the driving force input portion 2*a* is a chain sprocket. A part of the output of the engine 50 is changed into the driving force, and then the driving force is input to the driving force input portion 2*a* through a chain. The housing 2 is provided with the driving force input portion 2*a* at a position overlapping the second rotor 4 in the axial direction.

The first sliding portion 2*b* is provided at the inside of one end of the housing 2. The second sliding portion 2*c* is provided at the inside of the other end of the housing 2. The housing vane portions 2*d* are provided in the housing 2 at the inside of a middle portion between the sliding portions 2*b* and 2*c*. An inner cylindrical surface partially divided by the housing vane portion 2*d* is provided at a portion other than the housing vane portions 2*d* of the middle portion. The inner diameter of this portion is an inner diameter of the housing 2.

Specifically, the sliding portions 2*b* and 2*c* each have an inner diameter larger than the inner diameter of the housing 2, and are concentrically provided at the whole inner circumference of the housing 2. The first sliding portion 2*b* has a given depth from one end of the housing 2 in the axial direction, and the second sliding portion 2*c* has a given depth from the other end thereof The housing vane portions 2*d* each have a cross section perpendicular to the axial direction, and the cross section is narrower in the radially inward direction such that the housing vane portions 2*d* have the same fan shapes. In this regard, the radial inner side of the housing vane portion 2*d* is provided with an inner circumferential surface concentric with the inner cylindrical surface of the middle portion of the housing 2. The width of the housing vane portion 2*d* in the axial direction depends on the depths of the sliding portions 2*b* and 2*c*. The plural (herein, two) housing vane portion 2*d* are provided.

The first rotor 3 includes: a rotor body 3*a*, a cylindrical portion 3*b*, and a first vane portion 3*c*. The rotor body 3*a* has a disc shape. The rotor body 3*a* is provided at its center with a center bolt insertion hole 3*aa* which concentrically extends in the axial direction. The first rotor 3 is provided at its outer circumferential portion of the rotor body 3*a* with a sliding portion 3*ab* slidable with respect to the housing 2. The outer diameter of the rotor body 3*a* is set to be substantially the same as the inner diameter of the first sliding portion 2*b*. The width of the rotor body 3*a* in the axial direction is set to be substantially the same as the depth of the first sliding portion 2*b*.

The cylindrical portion 3*b* axially extends from an end, assembled into the housing 2, of both ends of the rotor body 3*a*. The cylindrical portion 3*b* is concentric with the rotor body 3*a*. The outer diameter of the cylindrical portion 3*b* is set to be substantially the same as the inner diameter of the inner circumferential surface of the housing vane portion 2*d*. The width of the cylindrical portion 3*b* in the axial direction is set to be substantially the same as the width of the housing vane portion 2*d* in the axial direction.

The first vane portions 3*c* are provided at the rotor body 3*a* and the cylindrical portion 3*b*. The first vane portions 3*c* axially extend from the end, assembled into the housing 2, of both ends of the rotor body 3*a*. Further, the first vane portions 3*c* each have a cross section perpendicular to the axis, and the cross section is wider in the radially outward direction such that the first vane portions 3*c* have the same fan shapes.

The first vane portion 3*c* has an outer circumferential surface which is located at the radial outer side thereof and which is concentric with the rotor body 3*a*. The outer diameter of this outer circumferential surface is set to be substantially the same as the inner diameter of the inner cylindrical surface of the middle portion of the housing 2. The width of the first vane portion 3*c* in the axial direction is substantially the same as the width of the cylindrical portion 3*b* in the axial direction. The plural (herein, two) first vane portions 3*c* are provided.

The second rotor 4 includes a rotor body 4*a* and second vane portion 4*b*. The rotor body 4*a* has a disc shape. The rotor body 4*a* is provided at its center with a camshaft insertion hole 4*aa* which concentrically extends in the axial direction. The camshaft insertion hole 4*aa* has a smaller diameter at one end opposite to the other end into which the camshaft 10 is inserted in the axial direction. The inner diameter of the smaller diameter portion of the camshaft insertion hole 4*aa* is larger than the inner diameter of the cylindrical portion 3*b* and is smaller than the outer diameter of the cylindrical portion 3*b*. An end surface of the smaller diameter portion of the camshaft insertion hole 4*aa*, selected from both end surfaces of the rotor body 4*a*, is assembled into the housing 2.

The second rotor 4 is provided at its outer circumferential portion of the rotor body 4*a* with a sliding portion 4*ab* slidable with respect to the housing 2. The outer diameter of the rotor body 4*a* is set to be substantially the same as the inner diameter of the second sliding portion 2*c*. The width of the rotor body 4*a* in the axial direction is set to be substantially the same as or larger than the depth of the second sliding portion 2*c*.

The second vane portion 4*b* axially extends from an end, assembled into the housing 2, of both ends of the rotor body 4*a*. Further, the second vane portions 4*b* each have a cross section perpendicular to the axis, and the cross section is gradually wider from the radial inner side to the radial outer side such that second vane portions 4*c* have the same fan shapes. The second vane portion 4*b* has an inner circumferential surface which is located at the radial inner side thereof and which is concentric with the rotor body 4*a*. The second vane portion 4*b* has an outer circumferential surface which is located at the radial outer side thereof and which is concentric with the rotor body 4*a*.

The inner diameter of the second vane portion 4*b* is set to be substantially the same as the outer diameter of the cylindrical portion 3*b*. The outer diameter of the second vane portion 4*b* is set to be substantially the same as the inner diameter of the inner cylindrical surface of the middle portion of the housing 2. The width of the second vane portion 4*b* in the axial direction is set to be substantially the same as the width of the housing vane portion 2*d* in the axial direction. The plural (herein, two) second vane portions 4*b* are provided.

The phase changing portion 1A has the single housing 2 including: advance hydraulic chambers R1 advancing wholly a phase of the camshaft 10 by oil hydraulic pressure; retard hydraulic chambers R2 retarding the phase of the camshaft 10 by oil hydraulic pressure; and phase difference hydraulic chambers R3 changing a difference in phase between the inner shaft and the outer shaft by oil hydraulic pressure. In the phase changing portion 1A, the housing 2 is sandwiched between the rotors 3 and 4.

In this regard, specifically, the first rotor 3 is provided to the housing 2 such that the rotor body 3*a* is accommodated by the first sliding portion 2*b* and the first vane portions 3*c* are accommodated by the middle portion. Also, the second rotor 4 is provided to the housing 2 such that the rotor body 4*a* is accommodated by the second sliding portion 2*c* and the second vane portions 4*b* are accommodated by the middle portion. Thus, the vane portions 2*d*, 3*c*, and 4*b* are arranged in the circumferential direction.

The vane portions 2*d*, 3*c*, and 4*b* arranged in the circumferential direction are pairs of the vane portions 2*d*, 3*c*, and 4*b*. In this regard, the phase changing portion 1A includes plural pairs (herein, two pairs) of the vane portions 2*d*, 3*c*, and 4*b*. Specifically, as for one pair of the vane portions 2*d*, 3*c*, and 4*d*, the housing vane portion 2*d*, the first vane portion 3*c*, and the second vane portion 4*b* are arranged in this order in the phase advance direction F.

The advance hydraulic chamber R1 is formed between the housing vane portion 2*d* and the first vane portion 3*c* adjacent to each other in the circumferential direction. Also, the retard hydraulic chamber R2 is formed between the housing vane portion 2*d* and the second vane portion 4*b* adjacent to each other in the circumferential direction. Further, the phase difference hydraulic chamber R3 is formed between the vane portions 3*c* and 4*b* adjacent to each other in the circumferential direction. The hydraulic chambers R1, R2, and R3 influence one another. In this regard, the hydraulic chambers R1 and R3 influence each other through the first vane portion 3*c*. The hydraulic chambers R2 and R3 influence each other through the second vane portion 4*b*. Also, the hydraulic chambers R1 and R2 influence each other through the vane portions 3*c* and 4*b*.

Such hydraulic chambers R1, R2, and R3 are arranged in the circumferential direction so as to define pairs of the hydraulic chambers R1, R2, and R3 influencing one another. The phase changing portion 1A includes plural pairs (herein, two pairs) of the hydraulic chambers R1, R2, and R3. As for the hydraulic chambers R1 to R3, specifically, the advance hydraulic chamber R1, the phase difference hydraulic chamber R3, and the retard hydraulic chamber R2 are arranged in this order in the phase advance direction F.

Next, the camshaft 10 will be described in more detail. The inner shaft 11 includes a shaft portion 11*a*, a head portion 11*b*, and the flange portion 11*c*. The shaft portion 11*a* is a main body of the inner shaft 11, and is inserted into the outer shaft 12. The head portion 11*b* is provided at one end of the shaft portion 11*a*. The head portion 11*b* has a columnar shape, and is inserted into the cylindrical portion 3*b* through the camshaft insertion hole 4*aa*. The outer diameter of the head portion 11*b* is set to be substantially the same as the inner diameter of the cylindrical portion 3*b*. The width of the head portion 11*b* in the axial direction is set to be greater than that of the cylindrical portion 3*b* in the axial direction.

The flange portion 11*c* is provided around the whole end, near the shaft portion 11*a*, of the head portion 11*b*. The outer diameter of the flange portion 11*c* is set to be greater than the smaller diameter portion of the camshaft insertion hole 4*aa* and smaller than the portion other than the smaller diameter portion. The inner shaft 11 is formed with a center bolt hole opening at the center of the head portion 11*b* and concentric thereto.

The outer shaft 12 includes a shaft portion 12*a*, and an end portion 12*b*, a flange portion 12*c*, and a hollow portion 12*d*. The shaft portion 12*a* is a main body of the outer shaft 12. The end portion 12*b* is provided at one end of the outer shaft 12. The end portion 12*b* has a columnar shape, and is inserted into the camshaft insertion hole 4*aa*. The outer diameter of the end portion 12*b* is set to be substantially the same as the inner diameter of the portion other than the smaller diameter portion of the camshaft insertion hole 4*aa*. The width of the end portion 12*b* in the axial direction is set to be smaller than the width of the portion other than the smaller diameter portion of the camshaft insertion hole 4*aa*.

The flange portion 12*c* is provided around an end, near the shaft portion 12*a*, of the end portion 12*b*. The flange portion 12*c* is formed with bolt insertion holes extending in the axial direction. Plural bolt insertion holes are formed at even intervals in the circumferential direction. The hollow portion 12*d* extends in the axial direction and is concentric. The hollow portion 12*d* has an inner cylinder surface, and opens at the center of the end portion 12*b*. The inner diameter of the hollow portion 12*d* is set to be substantially the same as the outer diameter of the shaft portion 11*a*.

The first rotor 3 is integrated with the inner shaft 11 and the second rotor 4 is integrated with the outer shaft 12 with the housing 2 sandwiched between the rotors 3 and 4, thereby providing the phase changing portion 1A to the camshaft 10. Specifically, the first rotor 3 is secured to the inner shaft 11 by the center bolt 21 to be integrated with the inner shaft 11. Specifically, the second rotor 4 is secured to the outer shaft 12 by plural fastening bolts 22 to be integrated with the outer shaft 12. The center bolt 21 is tightened into the center bolt hole through the center bolt insertion hole 3*aa*. The fastening bolt 22 is tightened into a bolt hole formed in the rotor body 4*a* through the bolt insertion hole.

A first knock pin 23 corresponding to a first positioning member is provided in the first rotor 3 and the inner shaft 11. Specifically, the first knock pin 23 is provided at the rotor body 3*a* and the head portion 11*b*. The first knock pin 23 positions the first rotor 3 and the inner shaft 11 in the circumferential direction. The second knock pin 24 corresponding to a second positioning member is provided in the second rotor 4 and the outer shaft 12. Specifically, the second knock pin 24 is provided at the rotor body 4*a* and the flange portion 12*c*. The second knock pin 24 positions the second rotor 4 and the outer shaft 12 in the circumferential direction.

In the phase changing device 100A, the inner shaft 11 is provided with the flange portion 11*c* to be sandwiched between the second rotor 4 and the outer shaft 12 with the phase changing portion 1A provided to the camshaft 10. In this regard, specifically, the flange portion 11*c* is arranged between the end portion 12*b* and the smaller diameter portion of the camshaft insertion hole 4*aa* of the second rotor 4 in the axial direction with the phase changing portion 1A provided to the camshaft 10. The width of the flange portion 11*c* in the axial direction is substantially the same as the width between the end portion 12*b* and the smaller diameter portion of the camshaft insertion hole 4*aa* of the second rotor 4 with the second rotor 4 integrated with the outer shaft 12.

In the phase changing device 100A, the inside of the outer shaft 12, selected from the inner shaft 11 and the outer shaft 12, is further provided with hydraulic path portions L1, L2, and L3 respectively communicating with the hydraulic chambers R1, R2, and R3. In this regard, the hydraulic path portions L1, L2, and L3 are provided in the outer shaft 12 and the second rotor 4. For example, the hydraulic path portions L1, L2, and L3 are provided in the outer shaft 12 and the second rotor 4 to intersect a wall defining the camshaft insertion hole 4*aa* from the end portion 12*b*.

In the phase changing device 100A, the outer shaft 12 is further provided at its circumferential portion with groove portions D1, D2, and D3 respectively communicating with the hydraulic path portions L1, L2, and L3. In this regard, one ends of the hydraulic path portions L1, L2, and L3 respectively communicate with the groove portions D1, D2, and D3, and the other ends of the hydraulic path portions L1, L2, and L3 respectively communicate with the hydraulic chambers R1, R2, and R3. The groove portions D1, D2, and D3 enable the hydraulic communication between the hydraulic path portions L1, L2, and L3 provided within the outer shaft 12 and the outside thereof.

Figure 6:
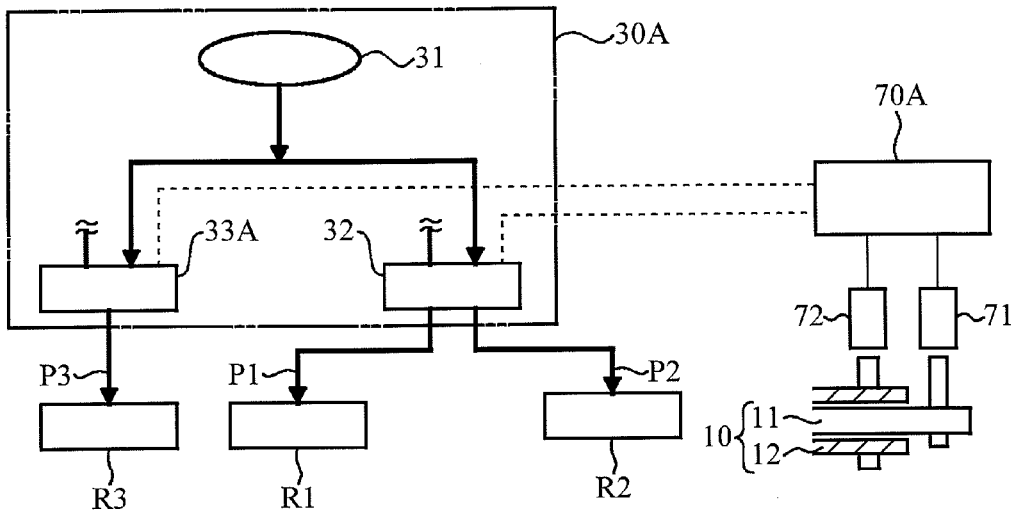
FIG. 6 is a view of a hydraulic circuit configuration of the first embodiment.

FIG. 6 is a view of a hydraulic circuit configuration of the phase changing device 100A. A hydraulic pressure P1 indicates a hydraulic pressure in the advance hydraulic chamber R1, a hydraulic pressure P2 indicates a hydraulic pressure in the retard hydraulic chamber R2, and a hydraulic pressure P3 indicates a hydraulic pressure in the phase difference hydraulic chamber R3. As illustrated in FIGS. 1 and 6, the hydraulic circuit portion 30A includes a pump 31, a first hydraulic control valve 32, and a second hydraulic control valve 33A. The pump 31 is connected to the hydraulic control valves 32 and 33A in a branch connection manner. The first hydraulic control valve 32 is connected to the hydraulic path portions L1 and L2. Therefore, the first hydraulic control valve 32 is connected to the hydraulic chambers R1 and R2 to supply the hydraulic pressure thereto. The second hydraulic control valve 33A is connected to the hydraulic path portion L3. Therefore, the second hydraulic control valve 33A is connected to the hydraulic chamber R3 to supply oil thereto.

The pump 31 supplies the hydraulic oil as the hydraulic fluid, and generates the hydraulic pressure. The hydraulic control valves 32 are 33A control the hydraulic pressures in the supply destinations. The first hydraulic control valve 32 controls the hydraulic pressures P1 and P2 in the hydraulic chambers R1 and R2. The second hydraulic control valve 33A controls the hydraulic pressure P3 in the phase difference hydraulic chamber R3.

Specifically, the first hydraulic control valve 32 can supply the hydraulic pressure to one of the hydraulic chambers R1 and R2. In this case, the hydraulic pressure can be released from the other of the hydraulic chambers R1 and R2. The first hydraulic control valve 32 can supply the hydraulic pressures to the hydraulic chambers R1 and R2. Also, the hydraulic pressures can be released from the hydraulic chambers R1 and R2, respectively. Specifically, the second hydraulic control valve 33A can supply the hydraulic pressure to the phase difference hydraulic chamber R3. Also, the hydraulic pressures can be released from the phase difference hydraulic chamber R3. The resistances of the hydraulic pressure supply paths against the hydraulic chambers R1, R2, and R3, are set to be substantially the same as one another.

The ECU 70A is an electronic controlling device, and controls the hydraulic control valves 32 and 33A to control the phase of the camshaft 10 (at least one of the phases of the inner shaft 11 and the outer shaft 12). Therefore, the engine valves 51 and 52 are controlled. The ECU 70A detects the phase of the inner shaft 11 based on the output of a phase detection sensor 71 provided in the inner shaft 11, and detects the phase of the outer shaft 11 based on the output of a phase detection sensor 72 provided in the outer shaft 12. For example, the ECU 70A can control the hydraulic control valves 32 and 33A based on the detected phases of the inner shaft 11 and the outer shaft 12 in order to position the phase of the camshaft 10.

Next, an example of the phase control of the phase changing device 100A will be described with reference to FIGS. 7A to 7D. FIGS. 7A to 7D are views of an example of the phase control of the phase changing device 100A and the characteristics of the engine valves 51 and 52. An example of the phase control will be described with reference to FIGS. 7A to 7D. In FIGS. 7A to 7D, the vertical axis indicates a valve lift amount, and the horizontal axis indicates a phase. TDC indicates the top dead center, and BDC indicates the bottom dead center. Additionally, a cam profile of the first cam C1 for driving the first engine valve 51 is the same as that of the second cam C2 for driving the second engine valve 52. These arrangements are not limited to this. For example, the cams C1 and C2 may have different cam profiles depending on the required engine performance. The cams C1 and C2 operate in the same phase with the vane portions 3*c* and 4*b* abutting each other.

Figure 7A:
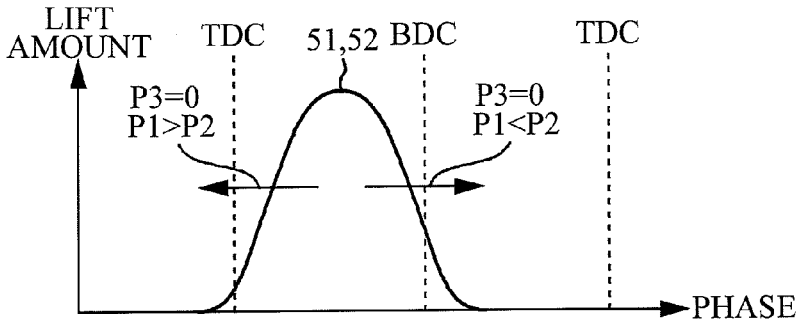
FIGS. 7A to 7D are views of an example of a phase control of the first embodiment.

FIG. 7A illustrates an example of the phase control to change the phases of the engine valves 51 and 52 simultaneously. In this case, the hydraulic pressure P3 is set to zero (P3=0), whereby the vane portions 3*c* and 4*b* abut each other. This results in that the phases of the engine valves 51 and 52 are the same as each other. At this time, the hydraulic pressure P1 is set higher than the hydraulic pressure P2 (P1>P2), whereby the rotors 3 and 4 advance simultaneously with the vane portions 3*c* and 4*b* abutting each other. This results in that the phases of the engine valves 51 and 52 advance simultaneously while the phases are the same as each other. Also, the hydraulic pressure P1 is set lower than the hydraulic pressure P2 (P1<P2), whereby the rotors 3 and 4 retard simultaneously with the vane portions 3*c* and 4*b* abutting each other. This results in that the phases of the engine valves 51 and 52 retard simultaneously while the phases are the same as each other.

In order to set the hydraulic pressure P3 to zero, the second hydraulic control valve 33A can be controlled to release the hydraulic pressure P3 in the phase difference hydraulic chamber R3. Also, in order to set the hydraulic pressure P1 higher than the hydraulic pressure P2 (P1>P2), the first hydraulic control valve 32 can be controlled to supply the hydraulic pressure to the advance hydraulic chamber R1 and to release the hydraulic pressure in the retard hydraulic chamber R2. In contrast, in order to set the hydraulic pressure P1 lower than the hydraulic pressure P2 (P1<P2), the first hydraulic control valve 32 can be controlled to release the hydraulic pressure in the advance hydraulic chamber R1 and to supply the hydraulic pressure to the retard hydraulic chamber R2.

Figure 7B:
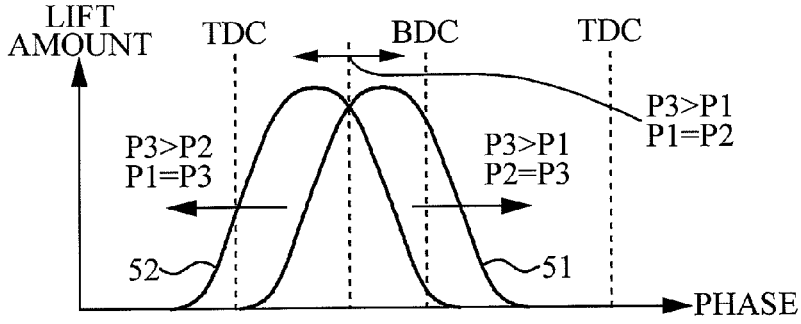

FIG. 7B illustrates an example of the phase control to increase the phase difference between the engine valves 51 and 52. In this case, the hydraulic pressure P3 is supplied to make the vane portions 3*c* and 4*b* spaced apart from each other. This results in an increase in the phase difference between the engine valves 51 and 52. At this time, each of the hydraulic pressures P1 and P2 is set lower than the hydraulic pressure P3 (P3>P1, P1=P2), whereby the first rotor 3 retards and the second rotor 4 advances. This results in that the first engine valve 51 retards and the second engine valve 52 advances.

Further, the hydraulic pressure P3 is set higher than the hydraulic pressure P2 (P3>P2) and the hydraulic pressure P1 is supplied such that the hydraulic pressures P1 and P3 are the same (P1=P3), whereby the phase of the second rotor 4, selected from the rotors 3 and 4, can be advanced. This results in that the phase of the engine valve 52, selected from the engine valves 51 and 52, can be advanced. In contrast, the hydraulic pressure P3 is set higher than the hydraulic pressure P1 (P3>P1) and the hydraulic pressure P2 is supplied such that the hydraulic pressures P2 and P3 are the same as each other (P2=P3), whereby the phase of the first rotor 3, selected from the rotors 3 and 4, can be retarded. This results in that the phase of the engine valve 51, selected from the engine valves 51 and 52, can be retarded.

In order to set each of the hydraulic pressures P1 and P2 lower than the hydraulic pressure P3 (P3>P1, P1=P2), the second hydraulic control valve 33A can be controlled to release the hydraulic pressures in the hydraulic chambers R1 and R2 and to supply the hydraulic pressure to the phase difference hydraulic chamber R3.

In order to set the hydraulic pressure P3 higher than the hydraulic pressure P2 (P3>P2) and to supply the hydraulic pressure P1 being the same as the hydraulic pressure P3 (P1=P3), the first hydraulic control valve 32 can be controlled to supply the hydraulic pressure to the advance hydraulic chamber R1 and to release the hydraulic pressure in the hydraulic chamber R2, and the second hydraulic control valve 33A can be controlled to supply the hydraulic pressure to the phase difference hydraulic chamber R3. In contrast, in order to set the hydraulic pressure P3 higher than the hydraulic pressure P1 (P3>P1) and to supply the hydraulic pressure P2 being the same as the hydraulic pressure P2 (P2=P3), the first hydraulic control valve 32 can be controlled to release the hydraulic pressure in the hydraulic chamber R1 and to supply the hydraulic pressure to the retard hydraulic chamber R2, and the second hydraulic control valve 33A can be controlled to supply the hydraulic pressure to the phase difference hydraulic chamber R3.

Figure 7C:
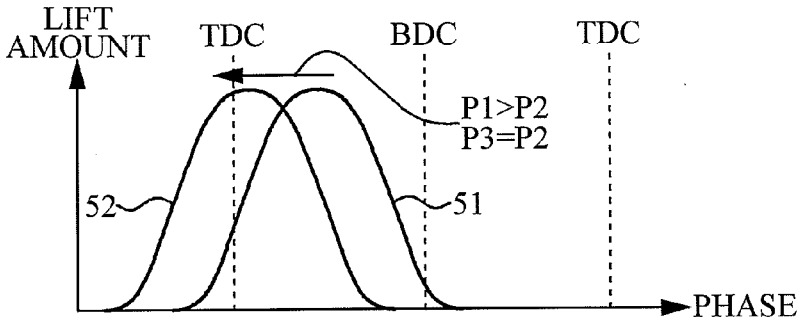

FIG. 7C illustrates an example of the phase control to advance the phases of the engine valves 51 and 52 simultaneously while keeping the phase difference constant. In this case, the hydraulic pressure P1 is set higher than the hydraulic pressure P2 (P1>P2) and the hydraulic pressure P3 is set the same as the hydraulic pressure P2 (P3=P2), whereby the phases of the rotors 3 and 4 can be advanced simultaneously while keeping the phase difference constant. This results in that the phases of the engine valves 51 and 52 advance simultaneously while keeping the phase difference constant.

In order to set the hydraulic pressure P1 higher than the hydraulic pressure P2 (P1>P2) and to set the hydraulic pressure P3 the same as the hydraulic pressure P2 (P3=P2), the first hydraulic control valve 32 can be controlled to supply the hydraulic pressure to the advance hydraulic chamber R1 and to release the hydraulic pressure in the hydraulic chamber R2, and the second hydraulic control valve 33A can be controlled to release the hydraulic pressure in the phase difference hydraulic chamber R3.

Figure 7D:
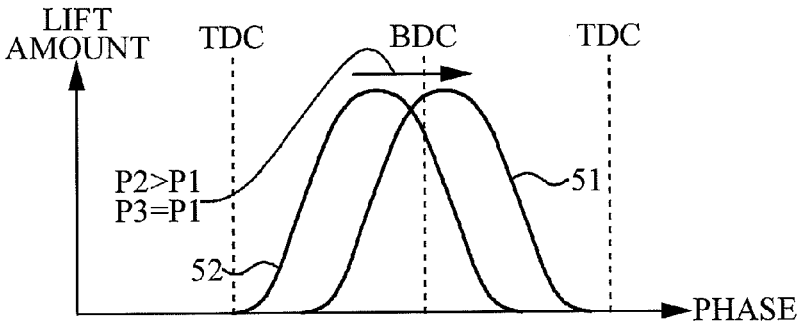

FIG. 7D illustrates an example of the phase control to retard the phases of the engine valves 51 and 52 simultaneously while keeping the phase difference constant. In this case, the hydraulic pressure P2 is set higher than the hydraulic pressure P1 (P2>P1) and the hydraulic pressure P3 is set the same as the hydraulic pressure P1 (P3=P1), whereby the phases of the rotors 3 and 4 can be retarded simultaneously while keeping the phase difference constant. This results in that the phases of the engine valves 51 and 52 can be retarded simultaneously while keeping the phase difference constant.

In order to set the hydraulic pressure P2 higher than the hydraulic pressure P1 (P2>P1) and to set the hydraulic pressure P3 the same as the hydraulic pressure P1 (P3=P1), the first hydraulic control valve 32 can be controlled to release the hydraulic pressure in the hydraulic chamber R1 and to supply the hydraulic pressure to the retard hydraulic chamber R2, and the second hydraulic control valve 33A can be controlled to release the hydraulic pressure in the phase difference hydraulic chamber R3.

In this example of the phase control, the phases of the engine valves 51 and 52 can be positioned as follows. That is, in order to change the phases of the engine valves 51 and 52 simultaneously at the same phase, the hydraulic pressures P1 and P2 can be the same as each other. In contrast, in other cases, the hydraulic pressures P1, P2, and P3 can be the same as one another. In order to set the hydraulic pressures P1 and P2 the same as each other, the first hydraulic control valve 32 can be controlled to supply the hydraulic pressures to the hydraulic chambers R1 and R2. In order to set the hydraulic pressures P1, P2, and P3 the same as one another, the second hydraulic control valve 33A can be controlled to supply the hydraulic pressures to the hydraulic chamber R3.

Next, effects of the phase changing device 100A will be described. The phase changing device 100A includes the phase changing portion 1A having the single housing 2 defining the hydraulic chambers R1, R2, and R3. For this reason, since three hydraulic chambers control the phase of the camshaft 10 having the dual structure, the phase changing device 100A has an advantage in downsizing. Also, since the single phase changing portion 1A controls the phase of the camshaft 10, there is another advantage in downsizing in view of suppressing the full length in the axial direction. Further, since the single phase changing portion 1A controls the phase of the camshaft 10, there is further an advantage of cost.

Since the phase changing device 100A includes the three hydraulic chambers R1, R2, and R3, the hydraulic path portions and the groove portions needed for supplying the hydraulic pressure from the outside of the phase changing portion 1A can be limited to three hydraulic path portions L1, L2, and L3 and three groove portions D1, D2, and D3. This also contributes to the advantage of downsizing.

In the phase changing device 100A, the single phase changing portion 1A controls the phase of the camshaft 10. This avoids the configuration of the camshaft 10 from being complicated. Also, since the phase changing portion 1A receives torque reaction forces of the inner shaft 11 and the outer shaft 12, the influence on the torque variation of the whole camshaft 10 is suppressed. This also results in improving the control performance of the phase of the camshaft 10.

The phase changing device 100A includes the hydraulic chambers R1, R2, and R3 arranged in the circumferential direction so as to define the pairs of the hydraulic chambers R1, R2, and R3 influencing one another. For this reason, since it is unnecessary to provide other walls partitioning the pair of the hydraulic chambers R1, R2, and R3 influencing one another, the phase changing device 100A can be downsized. Further, since the plural pairs of the hydraulic chambers R1, R2, and R3 are provided, the phase changing device 100A suitably suppresses the torque variation of the camshaft 10.

In the phase changing portion 1A of the phase changing device 100A, the housing 2 to which the drive force for driving the camshaft 10 being applied is sandwiched between the first rotor 3 for driving the inner shaft 11 and the second rotor 4 for driving the outer shaft 12. For this reason, since the phase changing device 100A has a simple structure having a small number of the parts and is assembled into the camshaft 10 with ease, there is an advantage of cost.

In this regard, specifically, in the phase changing portion 1A, the housing vane portions 2*d* provided in the housing 2, the first vane portions 3*c* provided in the first rotor 3, and the second vane portions 4*b* provided in the second rotor 4 are arranged within the housing 2 in the circumferential direction. Further, the advance hydraulic chamber R1 is provided between the housing vane portion 2*d* and the first vane portion 3*c* adjacent to each other in the circumferential direction, the retard hydraulic chamber R2 is provided between the housing vane portion 2*d* and the second vane portion 4*b* adjacent to each other in the circumferential direction, and the phase difference hydraulic chamber R3 is provided between the vane portions 3*c* and 4*b*. In such a way, the hydraulic chambers R1, R2, and R3 are provided.

In the phase changing device 100A, the rotors 3 and 4 are provided at their outer circumferential portions of the rotor bodies 3*a* and 4*a* with the sliding portions 3*ab* and 4*ab* slidable with respect to the housing 2, respectively. In this regard, when the tension force of the chain transmitting the driving force is applied to the housing 2, the force is also applied to the camshaft 10 to be bent. The force influences the sliding movement between the housing 2 and the first and second rotors 3 and 4, resulting in that the rotors 3 and 4 may not move smoothly. In contrast, since the sliding portions 3*ab* and 4*ab* slidable with the housing 2 are respectively provided at the circumferential portions of the rotor bodies 3*a* and 4*a* having the maximum diameters, the phase changing device 100A can suitably reduces the contact pressure caused by the force. Accordingly, this further ensures the smooth movements of the rotors 3 and 4.

In the phase changing device 100A, the housing 2 includes the driving force input portion 2*a* in such a position to overlap the second rotor 4 in the axial direction. In this regard, the second rotor 4 drives the outer shaft 12, in the camshaft 10, a bearing being provided between the outer shaft 12 and the engine 50.

Thus, the load is applied to the second rotor 4, whereby the phase changing device 100A suppresses the influence of the bending load. This results in suitably suppressing the core of the camshaft 10 from being displaced in the circumferential direction from the driving force input portion 2*a*, and this results in suitably suppressing the influence on the movement of the inner shaft 11. Also, in the phase changing device 100A, the second rotor 4 selected from the rotors 3 and 4 is firstly provided to the camshaft 10, selected from the rotors 3 and 4. Thus, the phase changing device 100A can suitably suppress the influence of the bending load.

In the phase changing device 100A, the inner shaft 11 is provided with the flange portion 11 c sandwiched between the second rotor 4 and the outer shaft 12 in the axial direction with the phase changing portion 1A provided to the camshaft 10. Thus, the phase changing device 100A can restrict the position of the inner shaft 11 relative to the outer shaft 12 in the axial direction the phase changing portion 1A provided to the camshaft 10.

The phase changing device 100A can position the inner shaft 11 and the outer shaft 12 in the axial direction by use of the flange portion 11*c*, and can position the rotors 3 and 4 in the axial direction at the same time. This results in facilitating the setting of the clearances between the vane portions 2*d*, 3*c*, and 4*b* in the axial direction. This can suitably suppress the leak of the hydraulic oil from the hydraulic chambers R1 and R2. Further, the phase changing portion is positioned in the axial direction when being provided to the camshaft 10, thereby facilitating the assembling to the camshaft 10.

Additionally, the phase changing device 100A further includes knock pins 23 and 24. This ensures the position between the inner shaft 11 and the first rotor 3 in the circumferential direction and the position between the outer shaft 12 and the second rotor 4 in the circumferential direction at the same time, when the phase changing portion 1A is provided to the camshaft 10. Thus, the phase changing portion 1A is positioned in the axial direction and the circumferential direction at the same time when the phase changing portion 1A is provided to the camshaft 10, thereby suitably facilitating the assembling to the camshaft 10.

In the phase changing device 100A, the inside of the outer shaft 12, selected from the inner shaft 11 and the outer shaft 12, is further provided with the hydraulic path portions L1, L2, and L3 respectively communicating with the hydraulic chambers R1, R2, and R3. This prevents the hydraulic path portions L1, L2, and L3 from being provided in the outer shaft 12 and the inner shaft 11. Thus, the phase changing device 100A prevents the hydraulic oil from leaking to the clearance between the inner shaft 11 and the outer shaft 12.

[Second Embodiment]

Figure 8:
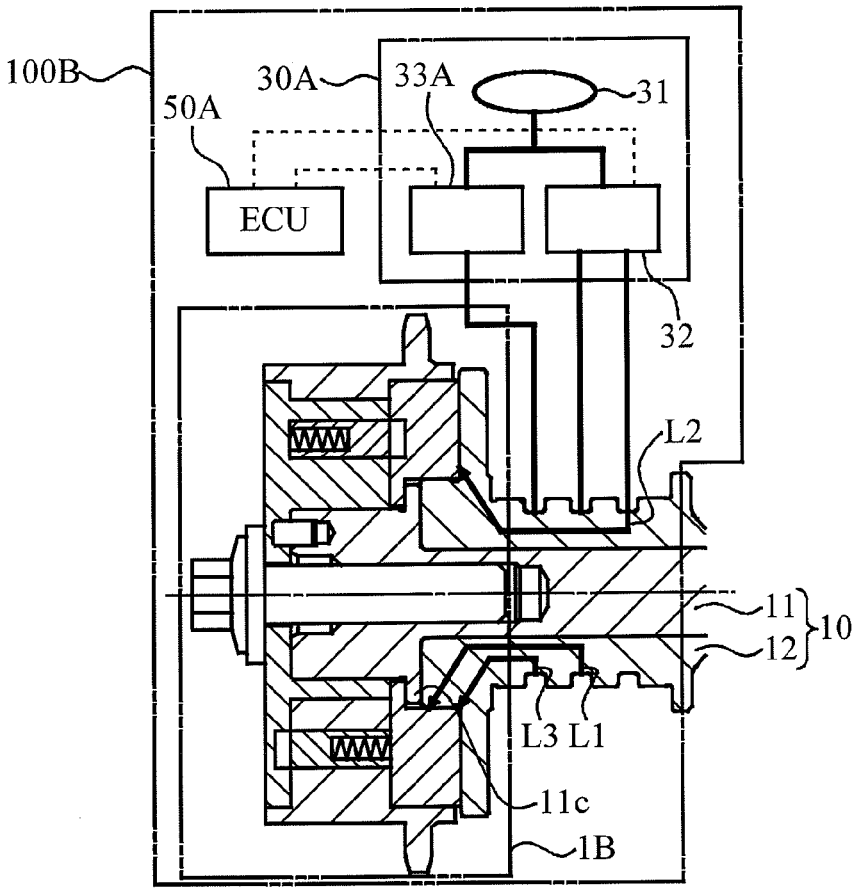
FIG. 8 is a view of a general configuration of a second embodiment.
Figure 9:
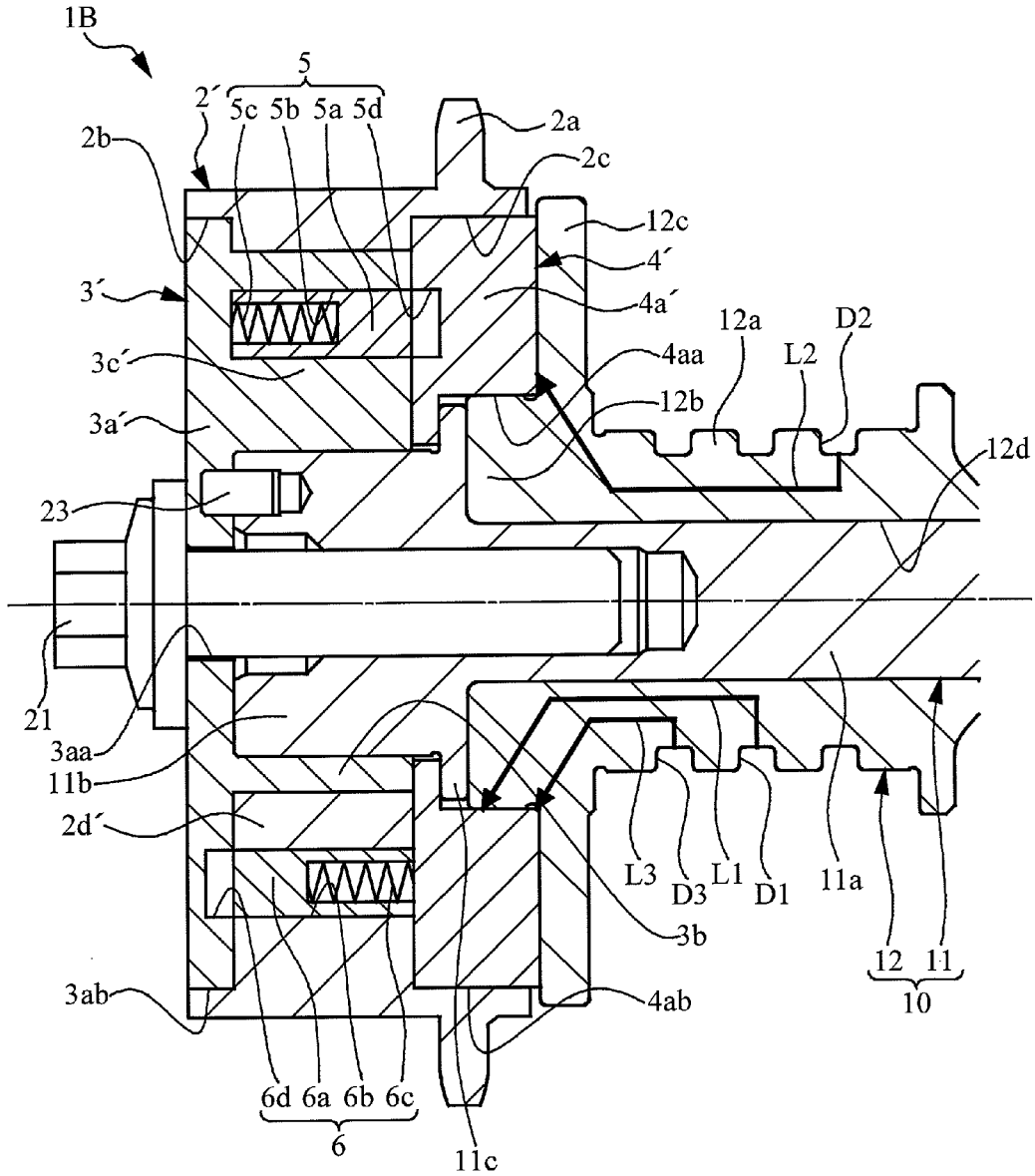
FIG. 9 is a first sectional view of the phase changing portion of the second embodiment.
Figure 10:
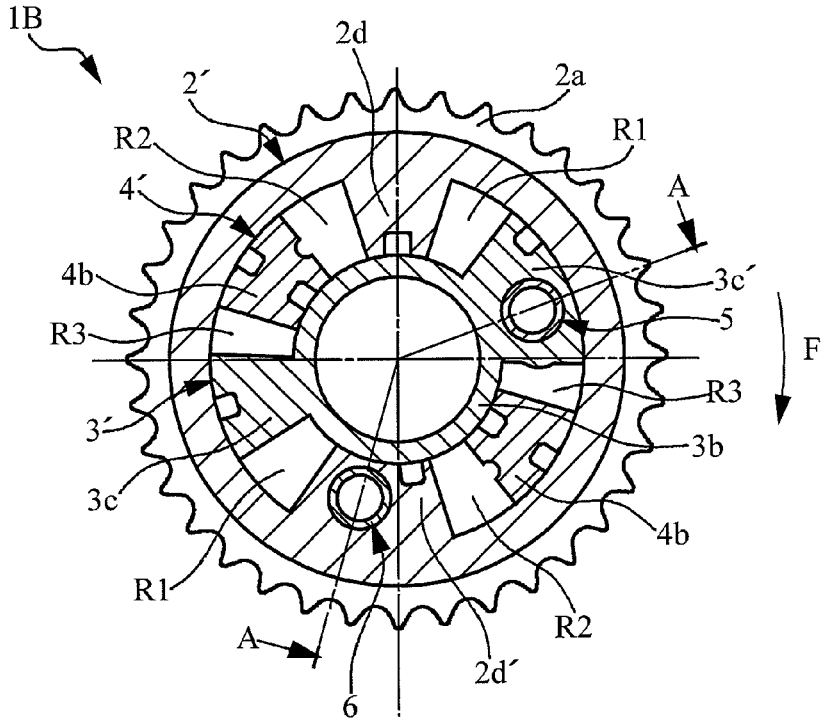
FIG. 10 is a second sectional view of the phase changing portion of the second embodiment.

FIG. 8 is a view of a general configuration of a phase changing device 100B. FIG. 9 is a first sectional view of a phase changing portion 1B. FIG. 10 is a second sectional view of the phase changing portion 1B. FIG. 9 illustrates a cross section, including a central axis, of the phase changing portion 1B. FIG. 10 illustrates a cross section perpendicular to the central axis of the phase changing portion 1B. FIG. 9 is a sectional view of the phase changing portion 1B taken along an A-A line of FIG. 10.

The phase changing device 100B is substantially the same as the phase changing device 100A, except that the phase changing portion 1B is provided instead of the phase changing portion 1A. The phase changing portion 1B is substantially the same as the phase changing portion 1A, except that a first locking mechanism 5 and a second locking mechanism 6 are further provided. Additionally, these variations are represented by references with dashes.

The first locking mechanism 5 includes: a first locking pin 5*a*; a first accommodating portion 5*b*; a first spring 5*c*; and a first engaging portion 5*d*. The second locking mechanism 6 includes: a second locking pin 6*a*; a second accommodating portion 6*b*; a second spring 6*c*; and a second engaging portion 6*d*. The structures of the locking mechanisms 5 and 6 are the same as each other. Thus, the first locking mechanism 5 will be described mainly.

The first locking pin 5*a* releasably restrains the relative movement between rotors 3' and 4'. The first accommodating portion 5*b* accommodates the first locking pin 5*a* for sliding in the axial direction. The first spring 5*c* biases the first locking pin 5*a* to restrain the relative movement between the rotors 3' and 4'. The first locking pin 5*a* engages the first engaging portion 5*d* to restrain the relative movement between the rotors 3' and 4'.

The first locking mechanism 5 is provided in the rotors 3' and 4'. In this regard, the first accommodating portion 5*b* of the first locking mechanism 5 is provided in the first rotor 3' (specifically, at a first vane portion 3*c'*). Also, the first engaging portion 5*d* of the first locking mechanism 5 is provided in the rotor 4' (specifically, at a main portion 4*a'*). The first accommodating portion 5*b* may be provided in one of the rotors 3' and 4'. The first engaging portion 5*d* may be provided in the other of the rotors 3' and 4'.

The length of the first locking pin 5*a* is substantially the same as the length of the first accommodating portion 5*b* in the axial length. For this reason, the first locking pin 5*a* is formed at its bottom side with an accommodating portion for accommodating the first spring 5*b*. The first spring 5*c* is arranged within the first accommodating portion 5*b*, and biases the first locking pin 5*a* to the engaging portion 5*d* side. In contrast, the first engaging portion 5*d* communicates with the phase difference hydraulic chambers R3, and acts on the hydraulic pressure to release the restraint between the rotors 3' and 4'. The first engaging portion 5*d* is capable of communicating with the phase difference hydraulic chambers R3 adjacent thereto through a communication path formed at the bottom side of the first engaging portion 5*d*.

In the second locking mechanism 6, the second locking pin 6*a* releasably restrains the relative movement between a housing 2' and the first rotor 3'. Thus, the second locking mechanism 6 is provided in the housing 2' and the first rotor 3'. In this regard, the accommodating portion 6*b* of the second locking mechanism 6 is provided in the housing 2' (specifically, at one of the housing vane portions 2*d'*). Also, the second engaging portion 6*d* of the second locking mechanism 6 is provided in the first rotor 3' (specifically, at a main portion 3*a'*). In the second locking mechanism 6, the second engaging portion 6*d* communicates with the advance hydraulic chambers R1, and the second locking pin 6*a* acts on the hydraulic pressure to release the restraint between the housing 2' and the first rotor 3'.

Next, the operation of the locking mechanisms 5 and 6 will be described. Additionally, the locking mechanisms 5 and 6 are substantially the same as each other in the operation. Thus, the first locking mechanism 5 will be mainly described as an example herein. In the first locking mechanism 5, the first accommodating portion 5*b* faces the first engaging portion 5*d*, when the relative position between the rotors 3' and 4' is in a predetermined state. For example, a predetermined state is the state where the phase of the second rotor 4' relative to the first rotor 3' maximally retards. As for the second locking mechanism 6, a predetermined state is the state where the phase of the first rotor 3' relative to the housing 2' maximally retards.

When the relative phase between the rotors 3' and 4' is in a predetermined state, the forces act on the first locking pin 5*a* from the first accommodating portion 5*b* side and the first engaging portion 5*d* side. For example, the force from the first accommodating portion 5*b* side is the biasing force of the first spring 5*c*. For example, the force exerted from the first engaging portion 5*d* side depends on the hydraulic pressure P3 of the phase difference hydraulic chamber R3.

When the relative phase between the rotor 3' and 4' is in a predetermined state and the hydraulic pressure of the phase difference hydraulic chamber R3 is lower than a predetermined pressure, the force acting on the first locking pin 5*a* from the first accommodating portion 5*b* side is greater than that from the first engaging portion 5*d* side. Thus, the first locking pin 5*a* protrudes toward the first engaging portion 5*d*. As a result, the relative movement between the rotors 3' and 4' is restrained. For example, a predetermined pressure is set to decide whether or not the hydraulic pressure is supplied to the phase difference hydraulic chamber R3.

When the relative phase between the rotors 3' and 4' is in a predetermined state and the hydraulic pressure of the phase difference hydraulic chamber R3 is higher than a predetermined pressure, the force acting on the first locking pin 5*a* from the first engaging portion 5*d* side is greater than that from the from the first accommodating portion 5*b* side. Thus, the first locking pin 5*a* is accommodated in the first accommodating portion 5*b*. As a result, the relative movement between the rotors 3' and 4' is enabled (the restraint between the rotors 3' and 4' is released).

The first locking pin 5*a* operates in response to the hydraulic pressure P3 of the phase difference hydraulic chamber R3 in such a way, when the relative phase between the rotors 3' and 4' is in a predetermined state. Also, the first locking pin 5*a* operating in such a way restrains the relative movement between the rotors 3' and 4', when the hydraulic pressure P3 is lower than a predetermined pressure. Therefore, the first locking pin 5*a* can restrain the relative movement between the rotors 3' and 4' in a predetermined state, when the volume of the phase difference hydraulic chamber R3 is small or zero.

In the second locking mechanism 6, the second locking pin 6*a* operates in response to the hydraulic pressure P1 of the advance hydraulic chamber R1, when the relative phase between the housing 2' and the first rotor 3' is in a predetermined state. Also, the second locking pin 6*a* restrains the relative movement between the housing 2' and the rotor 3', when the hydraulic pressure P1 is lower than a predetermined pressure. Therefore, the second locking pin 6*a* can restrain the relative movement between the housing 2' and the rotor 3' in a predetermined state, when the volume of the advance hydraulic chamber R1 is small or zero.

The first locking pin 5*a* corresponds to a restraining portion (first restraining portion) releasably restraining the relative movement between the rotors 3' and 4'. The second locking pin 6*a* corresponds to a restraining portion (second restraining portion) releasably restraining the relative movement between the housing 2' and the first rotor 3'.

Next, effects of the phase changing device 100B will be described. In the phase changing device 100B, the first locking pin 5*a* releasably restrains the relative movement between the rotors 3' and 4'. Thus, the first locking pin 5*a* restrains the relative movement between the rotors 3' and 4', whereby the phase changing device 100B can restrain unnecessary movements of the rotors 3' and 4' caused by the difference in friction or torque between the inner shaft 11 and the outer shaft 12. It is therefore possible to avoid the adjacent vane portions 3*c* (or 3*c'*) and 4*b* from hitting each other. Also, the rotors 3' and 4' are certainly moved in an integrated manner, thereby improving the phase control performance simultaneously changing the phases of the rotors 3' and 4°.

Specifically, when the relative phase between the rotors 3' and 4' is in a predetermined state, the first locking pin 5*a* provided in the phase changing device 100B operates in response to the hydraulic pressure P3 of the phase difference hydraulic chamber R3. That is, specifically, with the above configuration, the phase changing device 100B avoids the adjacent vane portions 3*c* (or 3*c'*) and 4*b* from hitting each other, when the volume of the phase difference hydraulic chamber R3 is small. In this regard, the vane portions 3*c* (or 3*c'*) and 4*b* tend to hit each other as the volume of the phase difference hydraulic chamber R3 is small.

In the phase changing device 100B, the second locking pin 6*a* releasably restrains the relative movement between the housing 2' and the first rotor 3'.

Thus, for example, the second locking pin 6*a* restrains the relative movement between the housing 2' and the first rotor 3' in starting the engine 50, the phase changing device 100B avoids the housing 2', the first rotor 3', and the second rotor 4' from hitting one another caused by the rotational variation of the engine 50.

In a case where the engine 50 relatively retards the phase of the first engine valve 51 selected from the engine valves 51 and 52 so as to sufficiently retard the closing timing of the engine valve 51 relative to the bottom dead center in the intake stroke, the phase changing device 100B can improve the starting characteristics of the engine 50 as follows.

That is, for example, the relative movement between the housing 2' and the first rotor 3' is restrained with the relative phase of the rotor 3' relative to the housing 2' maximally retarded in starting the engine 50. This can ensure the amount of the intake air in starting the engine 50, and improves the starting characteristics thereof. Specifically, this is achieved by providing the second locking pin 6*a* which operates in response to the hydraulic pressure P1 of the advance hydraulic chamber R1 when the phase of the first rotor 3' relative to the housing 2' is maximally retarded.

[Third Embodiment]

Figure 11:
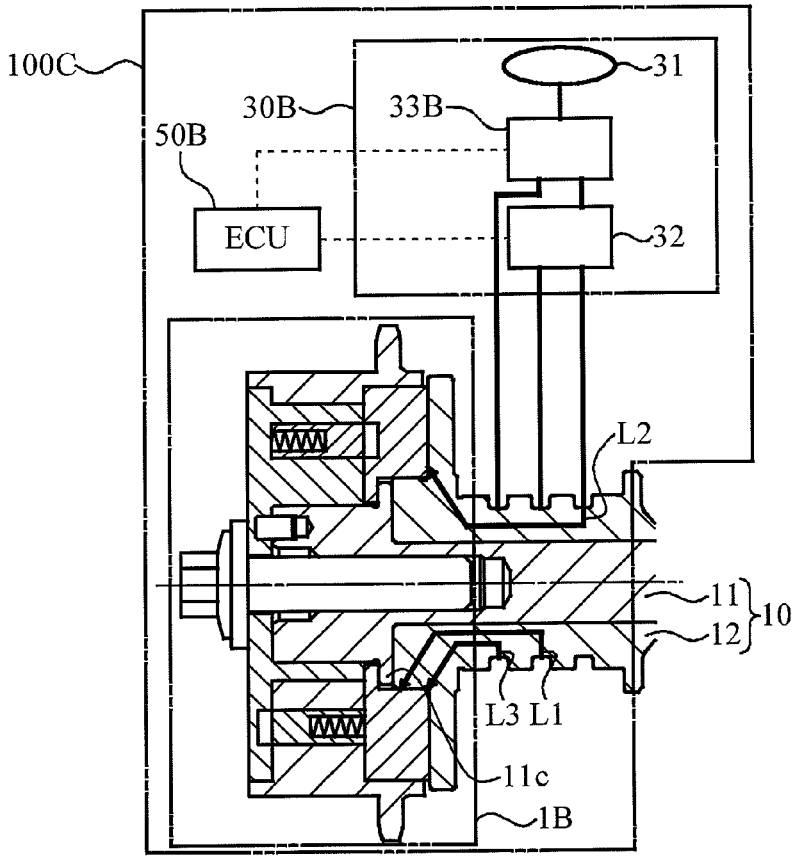
FIG. 11 is a general configuration of a third embodiment.
Figure 12:
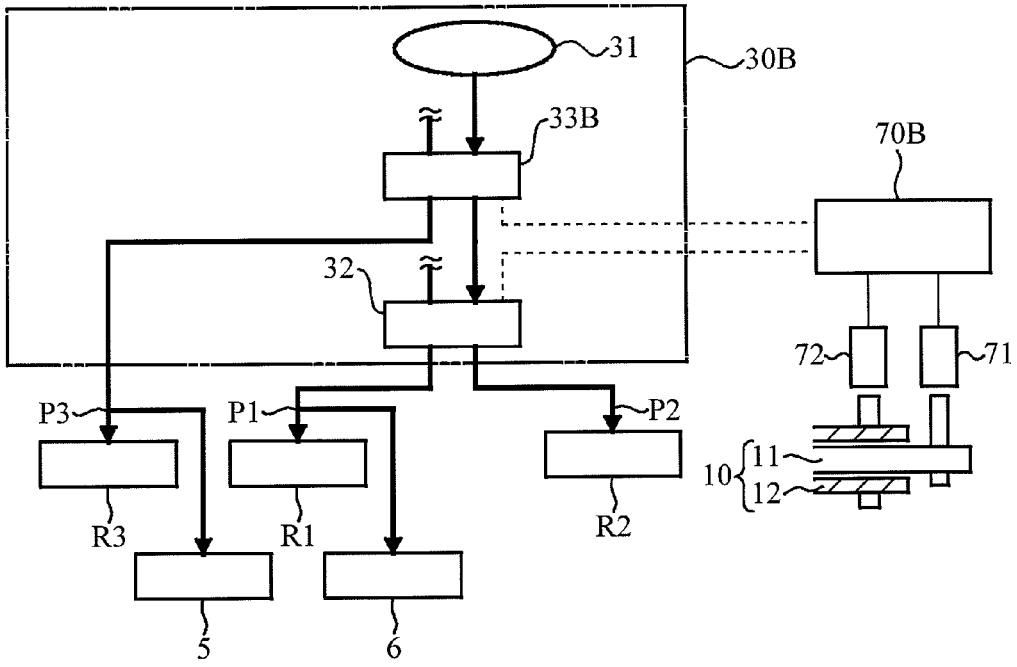
FIG. 12 is a view of a hydraulic circuit configuration of the third embodiment.

FIG. 11 is a general configuration of a phase changing device 100C. FIG. 12 is a view of a hydraulic circuit configuration of the phase changing device 100C. The phase changing device 100B is substantially the same as the phase changing device 100C, except that a hydraulic circuit portion 30B is provided instead of the hydraulic circuit portion 30A and an ECU 70B is provided instead of the ECU 70A.

The hydraulic circuit portion 30B includes: the pump 31; the first hydraulic control valve 32; and a second hydraulic control valve 33B. In the hydraulic circuit portion 30B, the first hydraulic control valve 32 is connected to the advance hydraulic chambers R1 and the retard hydraulic chambers R2, and controls the hydraulic pressure to be supplied. Also, the second hydraulic control valve 33B is connected to the first hydraulic control valve 32 and the phase difference hydraulic chambers R3, and controls the hydraulic pressure to be supplied. Thus, the second hydraulic control valve 33B and the first hydraulic control valve 32 are connected to each other in series. Also, the pump 31 is connected to the second hydraulic control valve 33B.

Specifically, the second hydraulic control valve 33B supplies the hydraulic pressure to one of the first hydraulic control valve 32 and the phase difference hydraulic chambers R3. In this case, the hydraulic pressure is released from the other. The second hydraulic control valve 33B supplies the hydraulic pressure to the first hydraulic control valve 32 and the phase difference hydraulic chambers R3. Also, the hydraulic pressure is released from the first hydraulic control valve 32 and the phase difference hydraulic chambers R3.

The ECU 70B controls the hydraulic control valves 32 and 33B to control the phase of the camshaft 10. Therefore, the phases of the engine valves 51 and 52 are controlled. In this regard, for example, the phase changing device 100C can control the hydraulic control valves 32 and 33B as follows. That is, for example, the first hydraulic control valve 32 can be controlled to supply the hydraulic pressure to the retard hydraulic chambers R2 in starting the engine 50. Also, the second hydraulic control valve 33B can be controlled to supply the hydraulic pressure to the first hydraulic control valve 32.

In this case, the hydraulic pressure P2 can be increased in starting the engine 50, and the hydraulic pressures P1 and P3 can be set to zero. Thus, the phase of the second rotor 4' relative to the first rotor 3' can be retarded. Also, the phase of the first rotor 3' relative to the hosing 2' can be retarded.

In this state, the first locking pin 5*a* restrains the relative movement between the rotors 3' and 4', and the second locking pin 6*a* restrains the relative movement between the housing 2' and the first rotor 3'. This can avoid the housing 2', the first rotor 3', and the second rotor 4' from hitting one another, and can improve the starting characteristics of the engine 50.

Also, for example, the first hydraulic control valve 32 can be controlled to control the hydraulic pressures in the hydraulic chambers R1 and R2 depending on the load of the engine 50, when the engine 50 is in a load driving state. Also, the second hydraulic control valve 33B can be controlled to supply the hydraulic pressure to the first hydraulic control valve 32.

The first hydraulic control valve 32 can be controlled to supply the hydraulic pressure to the advance hydraulic chamber R1, when the engine 50 is shifted to a high load state (for example, full load) from a middle load state (for example, partial load). Also, the first hydraulic control valve 32 can be controlled to supply the hydraulic pressure to the retard hydraulic chamber R2, when the engine 50 is shifted to the middle load state from the high load state. Also, in each case, the first hydraulic control valve 32 can be controlled to supply the hydraulic pressure to the hydraulic cambers R1 and R2 depending on the phases of the inner shaft 11 and the outer shaft 12.

In this case, the hydraulic pressure is supplied to the advance hydraulic chambers R1, whereby the hydraulic pressure P1 is higher than the hydraulic pressure P2 with the hydraulic pressure P3 set to zero. This results in simultaneously advancing the engine valves 51 and 52 at the same phase. Also, the hydraulic pressure is supplied to the retard hydraulic chambers R2, whereby the hydraulic pressure P2 is higher than the hydraulic pressure P1 with the hydraulic pressure P3 being zero. This results in simultaneously retarding the engine valves 51 and 52 at the same phase. Further, the hydraulic pressure is supplied to the hydraulic chambers R1 and R2, whereby the hydraulic pressure P1 and the hydraulic pressure P2 are the same. This results in simultaneously positioning the phases of the engine valves 51 and 52.

In this case, the first locking pin 5*a* can continuously restrain the relative movement between the rotors 3' and 4' since the engine 50 starts. On the other hand, the second locking pin 6*a* can release the restraint between the housing 2' and the rotor 3', when the engine 50 is changed to the high load state from the middle load state after the engine 50 starts. It is therefore to simultaneously change the phases of the engine valves 51 and 52 at the same phase. In this case, the output performance of the engine 50 can be ensured.

Next, effects of the phase changing device 100C will be described. In the phase changing device 100C, the first hydraulic control valve 32 is connected to the advance hydraulic chambers R1 and the retard hydraulic chambers R2, and controls the hydraulic pressure to be supplied. Also, the second hydraulic control valve 33B is connected to the first hydraulic control valve 32 and the phase difference hydraulic chambers R3, and controls the hydraulic pressure to be supplied.

Thus, the phase changing device 100C can control the first hydraulic control valve 32 such that the hydraulic pressures P1 and P2 to be cooperated with each other, when positioning the phase. Also, the second hydraulic control valve 33B can control at least one of the hydraulic pressures P1 and P2, and the hydraulic pressure P3 to cooperate with each other at the same time. Thus, the phase changing device 100C can prevent the hydraulic pressure deflection from occurring among the hydraulic chambers R1, R2, and R3, when positioning the phase. This results in further suitably control of the phase.

Specifically, the first hydraulic control valve 32 supplies the hydraulic pressure to the hydraulic chambers R1 and R2, whereby the phase changing device 100C can position the phase with the hydraulic pressures P1 and P2 cooperating with each other. Also, the second hydraulic control valve 33B supplies the hydraulic pressure to the first hydraulic control valve 32 and the phase difference hydraulic chamber R3, thereby positioning the phase with at least one of the hydraulic pressures P1 and P2 cooperating with the hydraulic pressure P3.

[Fourth Embodiment]

Figure 13:
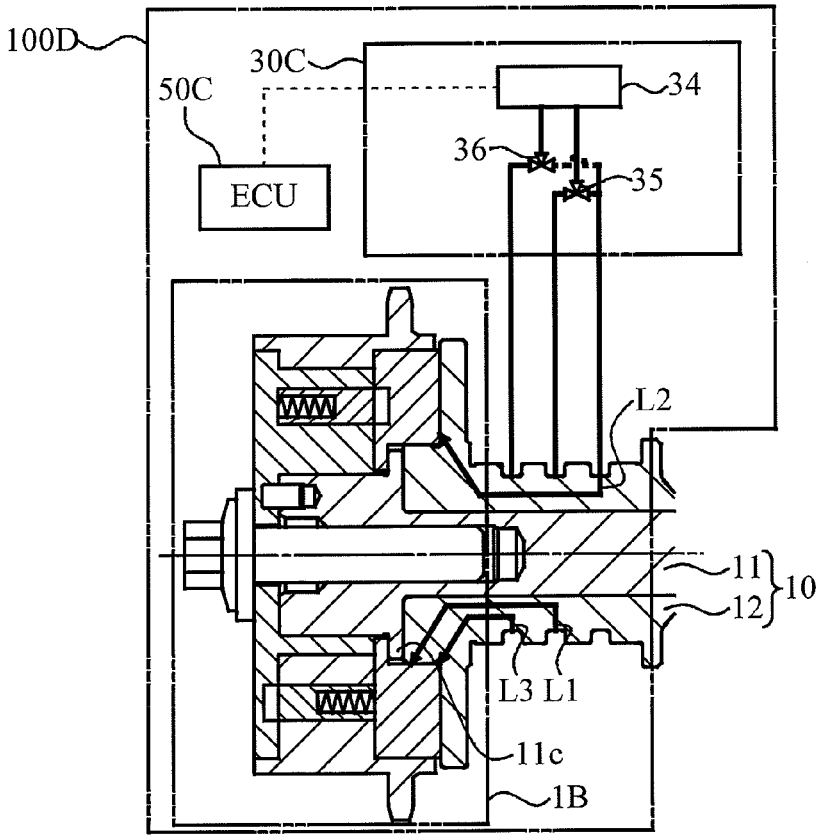
FIG. 13 is a general configuration view of a phase changing device of a fourth embodiment.
Figure 14A:
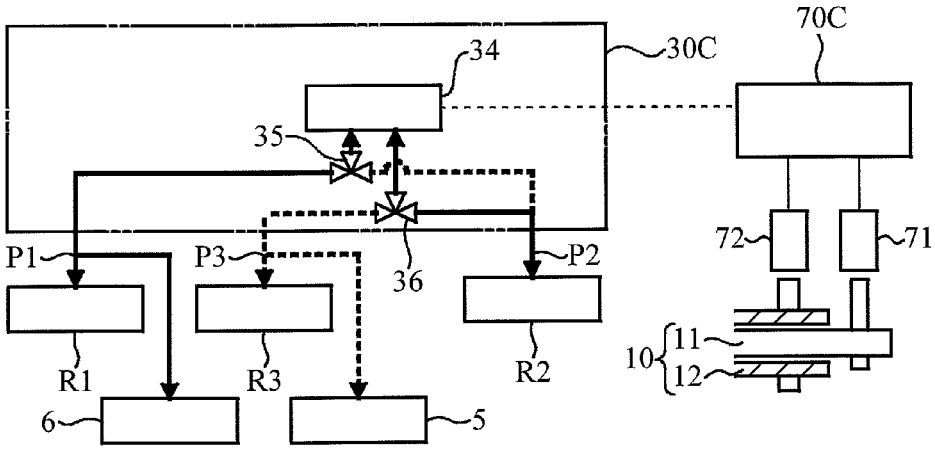
FIGS. 14A to 14C are views of a hydraulic circuit configuration of the fourth embodiment.
Figure 14B:
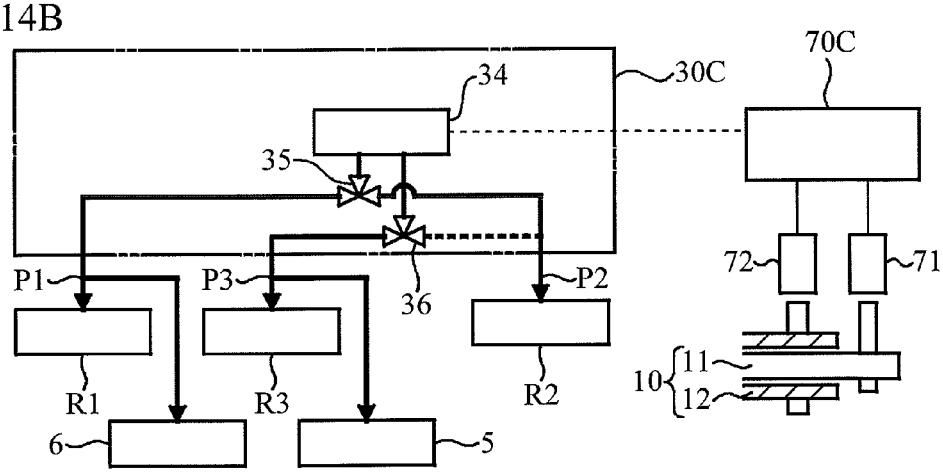
Figure 14C:
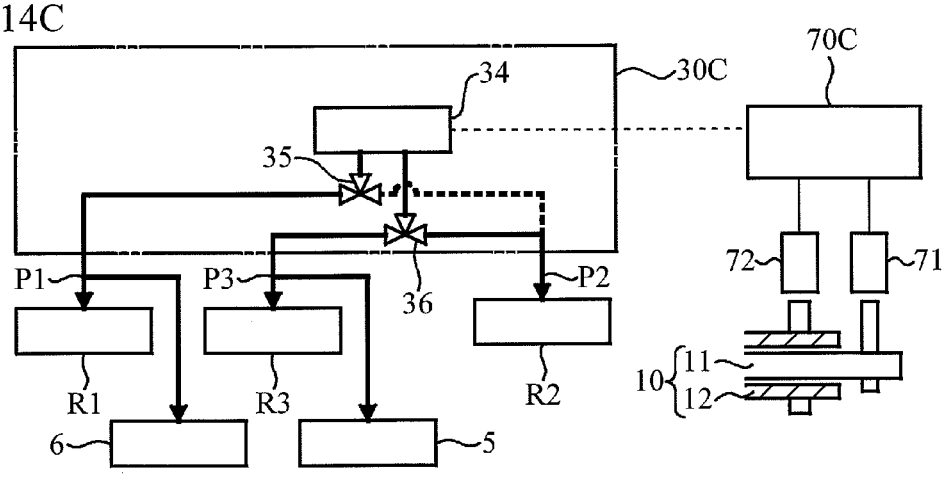

FIG. 13 is a general configuration view of a phase changing device 100D. FIGS. 14A to 14C are views of a hydraulic circuit of the phase changing device 100D. FIG. 14A illustrates a first switching example of a hydraulic circuit portion 30C. FIG. 14B illustrates a second switching example. FIG. 14C illustrates a third switching example. In FIGS. 14A to 14C, hydraulic pressure paths opened by three-way valves 35 and 36 are indicated by solid lines. Also, hydraulic pressure paths closed by the three-way valves 35 and 36 are indicated by broken lines. The phase changing device 100D is substantially the same as the phase changing device 100C, except that the hydraulic circuit portion 30C is provided instead of the hydraulic circuit portion 30B and an ECU 70C is provided instead of the ECU 70B.

The hydraulic circuit portion 30C includes a third hydraulic control valve 34, the first three-way valve 35, and the second three-way valve 36. The first three-way valve 35 is connected to the advance hydraulic chamber R1 and the retard hydraulic chamber R2, and switches the supply destination of the hydraulic pressure. The second three-way valve 36 is connected to the retard hydraulic chamber R2 and the phase difference hydraulic chamber R3, and switches the supply destination of the hydraulic pressure. The third hydraulic control valve 34 is connected to the three-way valve 35 and 36, and controls the hydraulic pressure to be supplied.

The third hydraulic control valve 34 duty-controls the hydraulic pressure to be supplied between the first three-way valve 35 and the second three-way valve 36. Specifically, the third hydraulic control valve 34 adjustably releases the hydraulic pressure from one of the first three-way valve 35 and the second three-way valve 36, and supplies the hydraulic pressure to the other. Afterward, the hydraulic pressures at the first three-way valve 35 side and the second three-way valve 36 side are the same. The hydraulic pressure may be individually supplied to the hydraulic circuit portion 30C in order to maintain the hydraulic pressure in the hydraulic circuit portion 30C.

The ECU 70C controls the third hydraulic control valve 34, and the three-way valves 35 and 36 to control the phase of the camshaft 10. This controls the phases of the engine valves 51 and 52. In this regard, for example, the phase changing device 100D can control the third hydraulic control valve 34, and the three-way valves 35 and 36 as follows.

That is, for example, the first three-way valve 35 can be controlled to communicate the third hydraulic control valve 34 with the advance hydraulic chamber R1, and the second three-way valve 36 can be controlled to communicate the third hydraulic control valve 34 with the retard hydraulic chamber R2, as illustrated in FIG. 14A.

In this case, the hydraulic pressure is adjustably released from the second three-way valve 36 side, in response to this, and the third hydraulic control valve 34 is controlled to supply the hydraulic pressure to the first three-way valve 35 side, whereby the engine valves 51 and 52 simultaneously advance at the same phase. Also, the hydraulic pressure is adjustably released from the first three-way valve 35 side, in response to this, and the third hydraulic control valve 34 is controlled to supply the hydraulic pressure to the second three-way valve 36 side, whereby the engine valves 51 and 52 simultaneously retard at the same phase.

Also, for example, the first three-way valve 35 can be controlled to communicate the third hydraulic control valve 34 with the advance hydraulic chamber R1 and the retard hydraulic chamber R2, and the second three-way valve 36 can be controlled to communicate the third hydraulic control valve 34 with the phase difference hydraulic chamber R3, as illustrated in FIG. 14B.

In this case, the hydraulic pressure is adjustably released from the first three-way valve 35 side, in response to this, and the third hydraulic control valve 34 is controlled to supply the hydraulic pressure to the second three-way valve 36 side, thereby increasing the phase difference between the engine valves 51 and 52. Also, the hydraulic pressure is adjustably released from the second three-way valve 36 side, in response to this, and the third hydraulic control valve 34 is controlled to supply the hydraulic pressure to the first three-way valve 35 side, thereby reducing the phase difference between the engine valves 51 and 52.

Also, for example, the first three-way valve 35 can be controlled to communicate the third hydraulic control valve 34 with the advance hydraulic chamber R1, and the second three-way valve 36 can be controlled to communicate the third hydraulic control valve 34 with the retard hydraulic chamber R2 and the phase difference hydraulic chamber R3, as illustrated in FIG. 14C.

In this case, the hydraulic pressure is adjustably released from the second three-way valve 36 side, in response to this, and the third hydraulic control valve 34 is controlled to supply the hydraulic pressure to the first three-way valve 35 side, thereby advancing the engine valves 51 and 52. The second engine valve 52 can be retarded relative to the first engine valve 51 at the same time, thereby reducing the phase difference between the engine valves 51 and 52. In this case, the phase of the first engine valve 51 can be advanced and the phase difference between the engine valves 51 and 52 can be reduced with the second engine valve 52 maximally advancing.

The three-way valves 35 and 36 can switch the supply destination of the hydraulic pressure with the hydraulic pressure at the first three-way valve 35 side being the same as the hydraulic pressure at the second three-way valve side. This can suppress a change in balance between the hydraulic pressures in the hydraulic chambers R1, R2, and R3 from being changed before and after switching. This results in the phases of the engine valves 51 and 52 should not be changed before and after switching. Also, the hydraulic path is changed to the retard hydraulic chamber R2 to which the torque reaction force is not applied from the camshaft 10, selected from the hydraulic chambers R1 and R2. This results in that the phases of the engine valves 51 and 52 should not be changed.

Figure 15A:
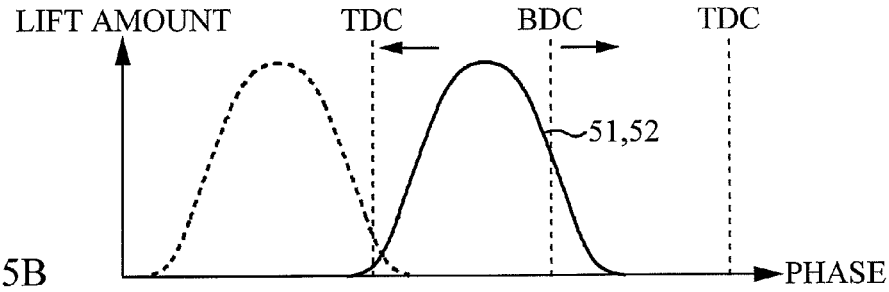
FIGS. 15A to 15E are views of an example of a phase control of the fourth embodiment.
Figure 15B:
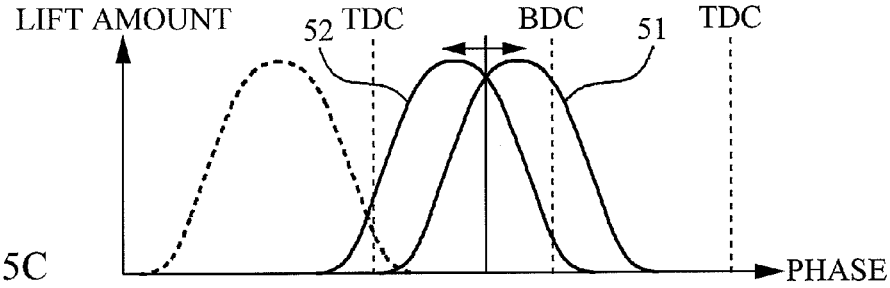
Figure 15C:
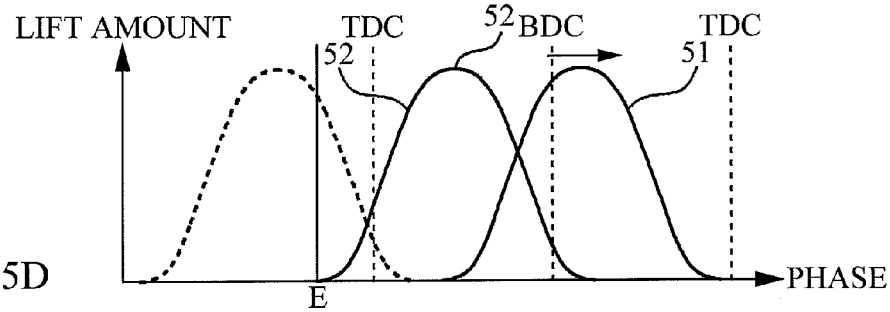
Figure 15D:
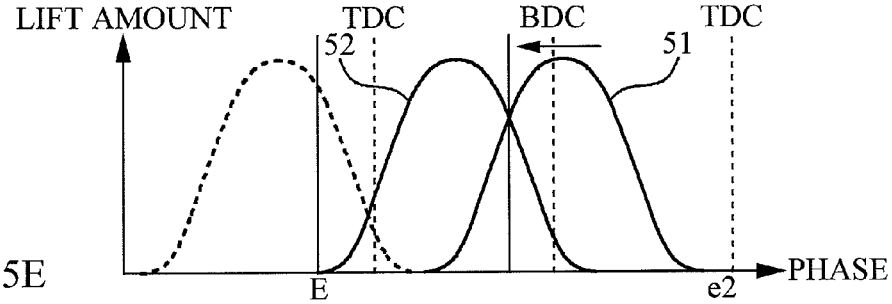
Figure 15E:
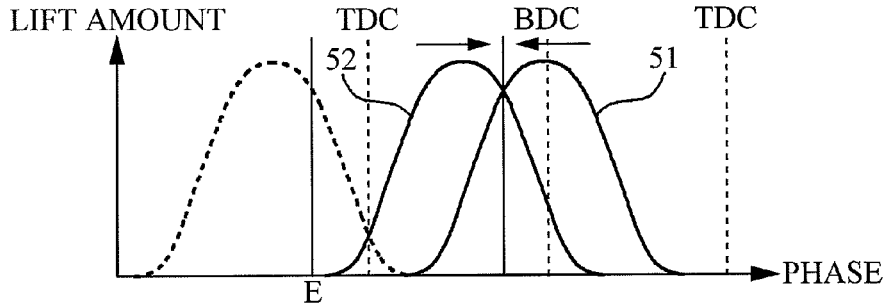

FIGS. 15A to 15E are views of examples of the phase control of the phase changing device 100D with valve characteristics of the engine valves 51 and 52. FIG. 15A illustrates the example of the phase control corresponding to FIG. 14A. FIGS. 15B, 15C, and 15E illustrate the examples of the phase control corresponding to FIG. 14B. FIG. 15D illustrates the example of the phase control corresponding to FIG. 14C. In the FIGS. 15A to 15E, the vertical axis indicates the amount of the valve lift, and the horizontal axis indicates the phase. Also, the valve characteristic of the exhaust valve is represented with broken lines in FIGS. 15A to 15E.

As illustrated in FIG. 15A, the engine valves 51 and the 52 can be advanced or retarded simultaneously at the same phase in the switched state illustrated in FIG. 14A. In the phase state illustrated in FIG. 15A and in the switched state illustrated in FIG. 14B, the phase of the first engine valve 51 is retarded and the phase of the second engine valve 52 is advanced as illustrated in FIG. 15B. This increases the phase difference between the engine valves 51 and 52. Further, in the switched state illustrated in FIG. 14B, when the phase of the second engine valve 52 maximally advances (when the opening timing corresponds to the phase E) as illustrated in FIG. 15C, the first engine valve 51 can be retarded from this state, thereby increasing the phase difference between the engine valves 51 and 52.

In the phase state illustrated in FIG. 15C and in the switched state illustrated in FIG. 14C, the phase of the first engine valve 51 can be advanced as illustrated in FIG. 15D, thereby reducing the phase difference between the engine valves 51 and 52. Also, in the phase state illustrated in FIG. 15D and in the switched state illustrated in FIG. 14C, the phase of the first engine valve 51 is advanced and the phase of the second engine valve 52 is retarded as illustrated in FIG. 15E, thereby reducing the phase difference between the engine valves 51 and 52.

Next, effects of the phase changing device 100D will be described. A phase changing device 100D can control the phase of the camshaft 10 by the single third hydraulic control valve 34. Thus, the phase changing device 100D controls the camshaft 10 to prevent the phase control of the camshaft 10 from becoming complicated, as compared with a case where plural hydraulic control valves are provided.

While the exemplary embodiments of the present invention have been illustrated in detail, the present invention is not limited to the above-mentioned embodiments, and other embodiments, variations and modifications may be made without departing from the scope of the present invention. In the above embodiment, the high-pressure pump used for the diesel engine is assumed. However, the same adjustment device is applicable to a fuel pump used for a gasoline engine.

[Description of Letters or Numerals]

phase changing portion 1A, 1B
housing 2, 2'
first rotor 3, 3'
second rotor 4, 4'
first locking pin 5*a*
second locking pin 6*a*
camshaft 10
inner shaft 11
outer shaft 12
oil hydraulic circuit portion 30A, 30B, 30C
pump 31
first hydraulic control valve 32
second hydraulic control valve 33A, 33B
third hydraulic control valve 34
first three-way valve 35
second three-way valve 36
engine 50
first engine valve 51
second engine valve 52
ECU 70A, 70B, 70C
phase changing device 100A, 100B, 100C, 100D

The invention claimed is:

1. A phase changing device of a camshaft provided to a dual structure camshaft which is rotated by a driving force input thereto and which includes an inner shaft and an outer shaft, the camshaft phase changing device comprising a phase changing portion comprising a single housing defining:

an advance hydraulic chamber advancing wholly a phase of the camshaft by a hydraulic pressure;

a retard hydraulic chamber retarding wholly the phase of the camshaft by a hydraulic pressure; and a phase difference hydraulic chamber changing a difference between a phase of the inner shaft and a phase of the outer shaft by a hydraulic pressure.

2. The phase changing device of the camshaft of claim 1, wherein the advance hydraulic chamber, the retard hydraulic chamber, and the phase difference hydraulic chamber are arranged in a circumferential direction of the camshaft, and define a pair of the hydraulic chambers acting on one another.

3. The phase changing device of the camshaft of claim 1, wherein the phase changing portion comprises:

a housing as the housing into which a driving force for driving the camshaft is input;

a first rotor driving the inner shaft; and a second rotor driving the outer shaft, and the housing is sandwiched between the first and second rotors.

4. The phase changing device of the camshaft of claim 3, wherein the first and second rotors respectively comprise rotor bodies, and each of the rotor bodies is provided at an outer circumferential portion with a sliding portion slidable with respect to the housing.

5. The phase changing device of the camshaft of claim 3, wherein the housing comprises a driving force input portion into which the driving force is input and which overlaps the second rotor in an axial direction.

6. The phase changing device of the camshaft of claim 3, wherein the inner shaft comprises a flange portion sandwiched between the second rotor and the outer shaft in an axial direction with the phase changing portion provided to the camshaft.

7. The phase changing device of the camshaft of claim 3, wherein the outer shaft selected from the inner and outer shafts is provided within the outer shaft with hydraulic path portions which respectively communicate with the advance hydraulic chamber, the retard hydraulic chamber, and the phase difference hydraulic chamber.

8. The phase changing device of the camshaft of claim 3, wherein the phase changing portion further comprises a restraining portion which releasably restrains a relative movement between the first and second rotors.

9. The phase changing device of the camshaft of claim 1, further comprising:

a first hydraulic control valve connected to the advance hydraulic chamber and the retard hydraulic chamber, and controlling a hydraulic pressure to be supplied; and a second hydraulic control valve connected to the first hydraulic pressure control valve and the phase difference hydraulic chamber, and controlling a hydraulic pressure to be supplied.

10. The phase changing device of the camshaft of claim 1, further comprising:

a first three-way valve connected to the advance hydraulic chamber and the retard hydraulic chamber, and switching a supply destination of the hydraulic pressure;

a second three-way valve connected to the retard hydraulic chamber and the phase difference hydraulic chamber, and switching a supply destination of the hydraulic pressure; and a hydraulic pressure control valve connected to the first and second three-way valves, and controlling a hydraulic pressure to be supplied.

* * * * *